US006484895B2

(12) United States Patent
Montgomery et al.

(10) Patent No.: US 6,484,895 B2
(45) Date of Patent: Nov. 26, 2002

(54) TWO STAGE DISPENSING CAP FOR PRESSURIZED CONTAINERS

(75) Inventors: Gary V. Montgomery, Evansville, IN (US); Joseph M. Ladina, Marietta, GA (US)

(73) Assignees: The Coca-Cola Company, Atlanta, GA (US); Rexam Medical Packaging Inc., Evansville, IN (US)

( * ) Notice: Subject to any disclaimer, the term of this patent is extended or adjusted under 35 U.S.C. 154(b) by 0 days.

(21) Appl. No.: 09/860,895

(22) Filed: May 18, 2001

(65) Prior Publication Data

US 2001/0032827 A1 Oct. 25, 2001

Related U.S. Application Data

(63) Continuation-in-part of application No. PCT/US00/31455, filed on Nov. 15, 2000, which is a continuation-in-part of application No. 09/440,973, filed on Nov. 16, 1999, now Pat. No. 6,170,683.

(51) Int. Cl.[7] ..... B65D 47/08

(52) U.S. Cl. ..... 215/237; 215/303; 215/307; 220/263; 220/835; 222/556

(58) Field of Search ..... 215/235, 225, 215/224, 223, 201, 237, 238, 243, 321, 303, 307; 220/259.1, 255, 263, 291, 292, 810, 831, 827, 835; 222/153.14, 153.06, 570, 550, 520, 548

(56) References Cited

U.S. PATENT DOCUMENTS

| | | | | | |
|---|---|---|---|---|---|
| 4,941,580 | A | * | 7/1990 | Julian | 215/235 |
| 5,740,933 | A | * | 4/1998 | Conti et al. | 215/224 |
| 5,779,072 | A | * | 7/1998 | Krebs | 215/235 |
| 5,829,609 | A | * | 11/1998 | Beck | 215/224 |
| 5,875,907 | A | * | 3/1999 | Lay | 220/259.1 |

* cited by examiner

*Primary Examiner*—Nathan J. Newhouse
(74) *Attorney, Agent, or Firm*—John F. Salazar; Middleton Reutlinger

(57) ABSTRACT

A two stage dispensing cap for a carbonated beverage container is described. The cap has a flip top which is hingedly connected to a collar wherein the collar is rotatable on the container. The cap, upon rotation of the collar, is first opened into a venting position wherein the flip top vents the pressurized contents of the container but remains locked partially closed. Continued rotation of the cap releases the locked flop top to allow the container to be fully opened. A set of cams on the container neck work in conjunction with annular beads to first allow partially opening of the flip top into the venting position and then allowing it to fully open.

24 Claims, 25 Drawing Sheets

TWO STAGE DISPENSING CAP FOR PRESSURIZED CONTAINERS

This application is a continuation in part of PCT/US00/31455 filed Nov. 15, 2000, which is a continuation in part of U.S. Application Ser. No. 09/440,973 Filed Nov. 16, 1999, now U.S. Pat. No. 6,170,683.

TECHNICAL FIELD

The present invention relates to closures and particularly to a double latch flip seal closure which is utilized in conjunction with a carbonated beverage and container.

BACKGROUND OF THE INVENTION

Flip top closures are fairly well known in the art. However, typical flip top closures incorporate a biased hinge and stationary base portion wherein the flip top portion of the closure is pushed forward by the biasing action of the hinge forcing the flip top up and away from the base portion of the closure. Further, most prior art flip top closures will not work appropriately with carbonated beverages as the contents are held under considerable pressure.

Other threaded closures are also fairly well known in the art for use with carbonated beverages. However, as is fairly well known, one of the drawbacks with use of standard threaded closures on carbonated beverages is a complete removal of the closure from the container thus allowing the closure to be dropped or misplaced after removal.

Of the known prior art, U.S. Pat. No. 4,941,580 discloses a flip top dispensing closure having a base ring which is rotatable. As is shown in some of the embodiments, rotation causes opening of a lid which is hingedly connected to the base ring. However, this closure lacks many fundamental aspects of a flip top closure necessary for use with carbonated beverages and does not adequately provide sufficient sealing integrity or a mechanism for two stage opening of the container. Further, when the flip top closure is placed in the open position, the opening structure prevents the flip top from being closed in that position thereby preventing immediate closing and possibly confusing the user.

The prior art therefore is lacking in a double latch flip top closure with sufficient sealing integrity which has a rotatable base allowing the flip top to be actuated by rotation of the base portion in a manner suitable for use in conjunction with carbonated beverage containers.

SUMMARY OF THE INVENTION

It is therefore been desired to provide a double latch flip top closure with sufficient sealing integrity which is available for use in conjunction with carbonated beverage containers. It is accordingly an object of the present invention to provide such a flip top closure which is a two-piece closure having a double staged opening process and which is suitable for use with carbonated beverages under high pressure. Typically, closures that are utilized on containers having carbonated beverages contained therein must provide adequate sealing for high pressure containment. Such objective is difficult to meet utilizing commonly known prior art flip top dispensers. The two-piece flip seal for carbonated beverages of the present invention meets this objective.

Another object of the present invention is to provide a double latch flip top closure which allows the user to vent the gas from within the container prior to fully opening the container. Additionally, an object of the present invention is to provide a double latch closure which allows the flip top to be closed when at the same location on the container rotationally that it has been opened, thus allowing the flip top to be fully opened and closed along the same circumferential point on the container neck.

An additional object of the present invention is to provide a double latch dispensing closure for utilization with pressurized containers wherein the flip top portion of the cap has a biased hinge which forces the flip top cap into the open or closed position.

An additional object of the present invention is to provide a two-stage dispensing cap for pressurized containers wherein the flip top has an annular plug seal or dome shaped sealing disc for tight sealing of the flip top with the container.

It is a further object of the present invention to provide a flip top closure which has adequate tamper-indicating means located thereon such that upon first use of the two-stage dispensing cap, visual means are provided indicating prior use.

A further object of the present invention is to provide a two-stage dispensing cap for utilization with pressurized containers wherein the dispensing cap remains permanently attached to the neck of the container, but is rotatable thereon.

It is an additional object in conjunction herewith to provide a two-stage dispensing closure which provides primary lugs for activation of the flip top upon initial rotation of the closure and which further provides for complete opening of the flip upon continued rotation of the collar for the closure.

A further object of the present invention is to provide a two stage dispensing cap for attachment to a container, comprising a collar rotatably affixed to said container, a flip top hingedly connected to said collar having a top wall and a depending side wall, said side wall having a lifting lug and a lid retaining lug co-aligned on the interior thereof, said lifting lug above said lid retaining lug, wherein said container further has an upper bead and a lower bead directly therebelow, a primary upper cam and a primary lower cam, said primary upper cam co-aligned with said primary lower cam, said primary upper cam extending upward from the upper surface of said upper bead, said primary lower cam extending downward from said lower bead, and further having a secondary cam, said secondary cam extending downward from said upper bead and located rotationally past said primary cams.

All of the above outlined objectives are to be understood as exemplary only and many more objectives of the invention may be gleaned from the disclosure herein. Therefore, no limiting interpretation of the objectives noted are to be understood without further reading of the entire specification and drawings included herewith.

BRIEF DESCRIPTION OF THE DRAWINGS

A better understanding of the invention will be had upon reference to the following description in conjunction with the accompanying drawings in which like numerals are referred to like parts and wherein.

DETAILED DESCRIPTION OF THE PREFERRED EMBODIMENT

Figure 1:
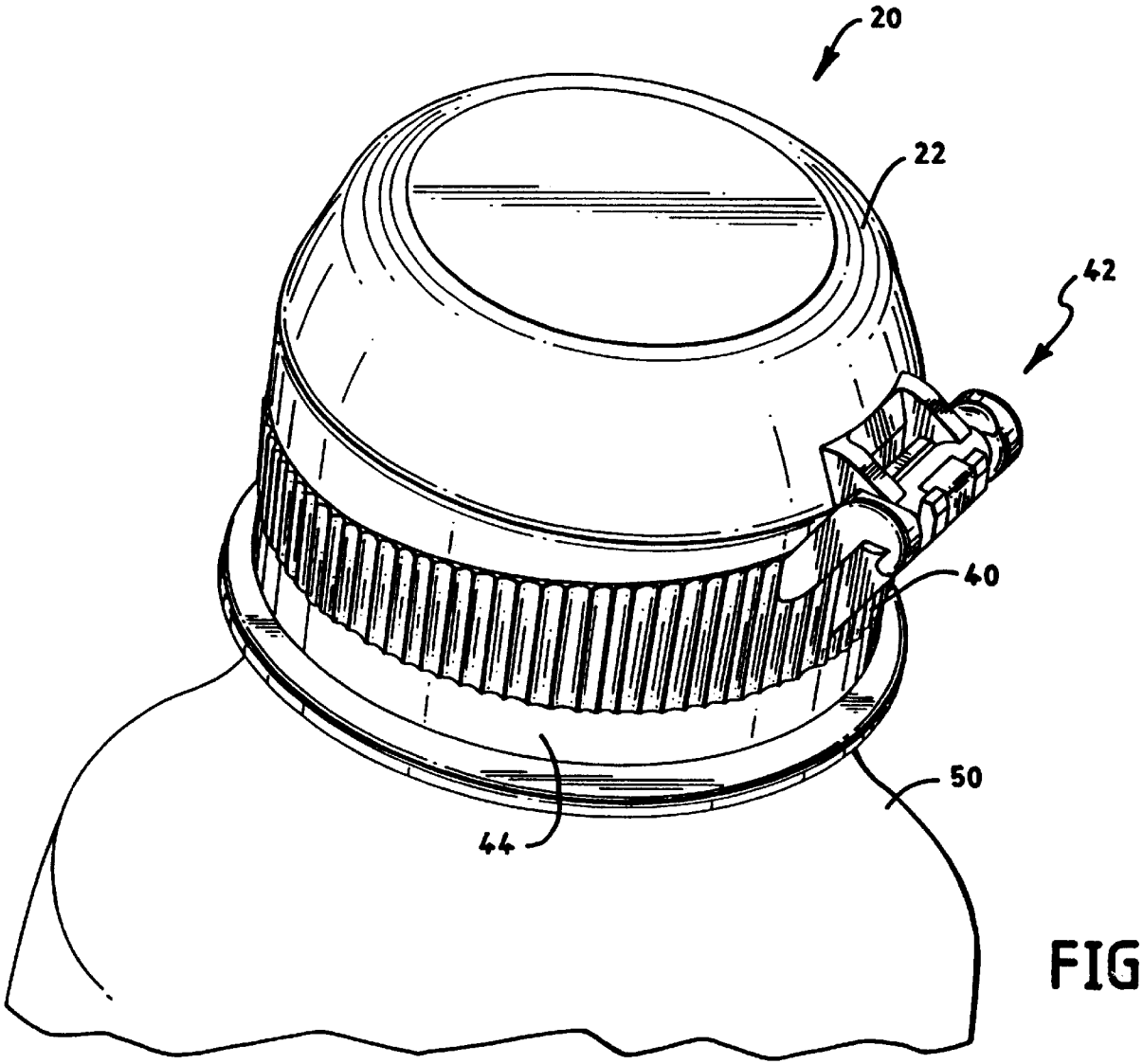
FIG. 1 is a perspective view of the two-stage double latch dispensing cap for pressurized containers of the present invention.

The two-staged double latch dispensing cap 20 for pressurized containers is depicted in FIG. 1. The dispensing cap 20 is comprised of an upper flip top portion 22 and a lower collar portion 40 which are combined together and retained upon the neck of container 50 and rotatable thereon. The two-stage dispensing cap 20 described herein is particularly designed for use in combination with containers which hold pressurized beverages such as carbonated beverages. However, the dispensing cap 20 may also be used with non-carbonated beverages where a gas is used to pressurize the container after filling. The cap 20 of the present invention is uniquely designed for use in conjunction with such a pressurized container so that the flip top 22 does not separate from the collar 40 upon initial opening of the cap. The flip top 22 of the cap 20 is opened upon rotation in the counter-clockwise direction of the dispensing cap 20 thereby causing the flip top 22 to partially open, venting pressurized gases held within the container 50. Continued counter-clockwise rotation of the collar 40 will cause the flip top 22 to be removed from the mouth container 50 while retained to the collar 40 via hinge 42. The dispensing cap 20, as is shown in FIG. 1, thereby requires a first and second opening mechanism for allowing the venting of the container without the flip top 22 being completely released from the mouth of the container 50 combined with the second stage caused by further rotation of the cap 20 forcing the flip top 22 up and away from the mouth of the container. The flip top portion 22 thereby rotates about the hinge 42 while being retained to collar 40. Further, a tampering indicating feature 44 may be utilized on the two-stage dispensing cap 20 of the present invention for indication of prior rotational opening.

Figure 2:
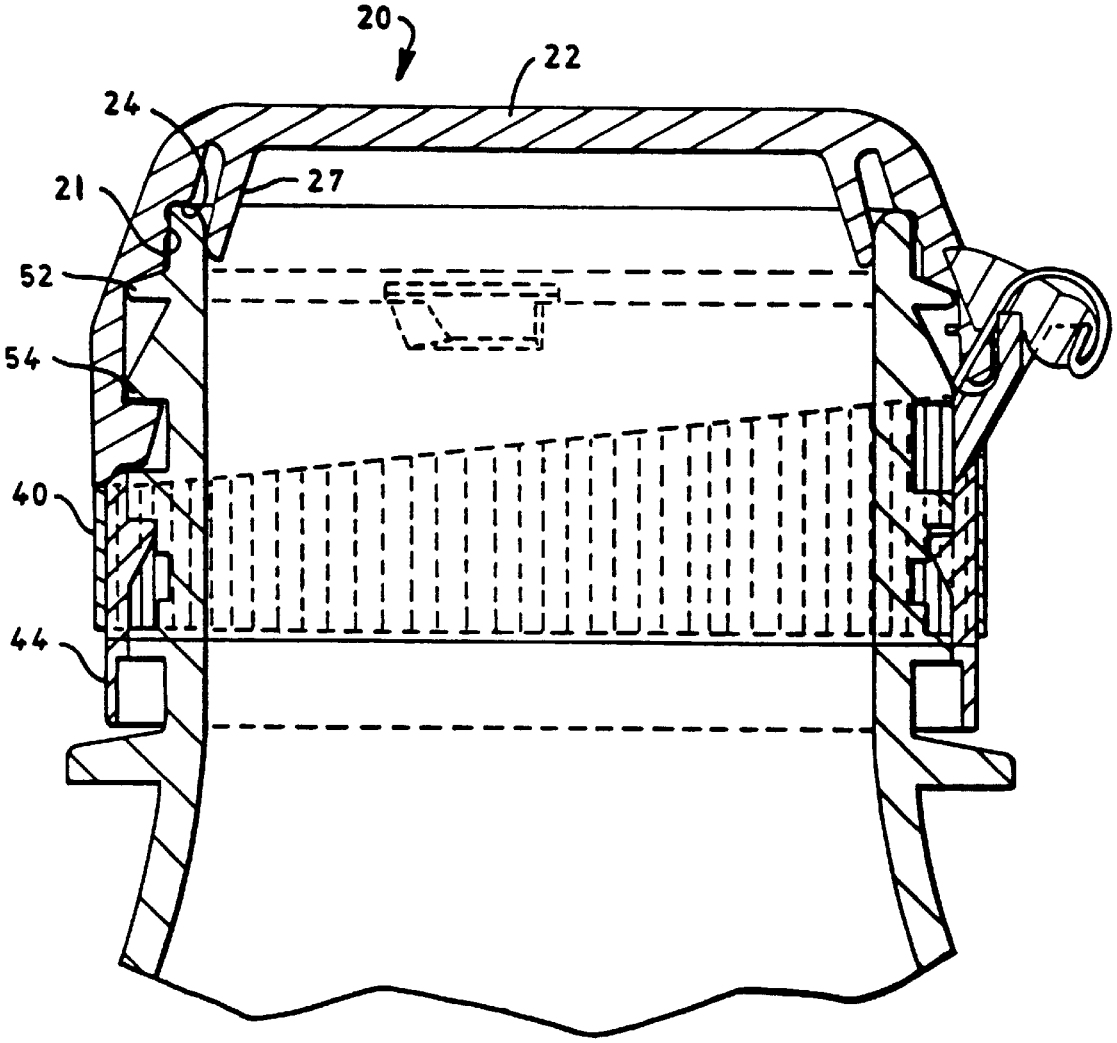
FIG. 2 is side sectional side view of the dispensing cap depicted in FIG. 1.
Figure 7:
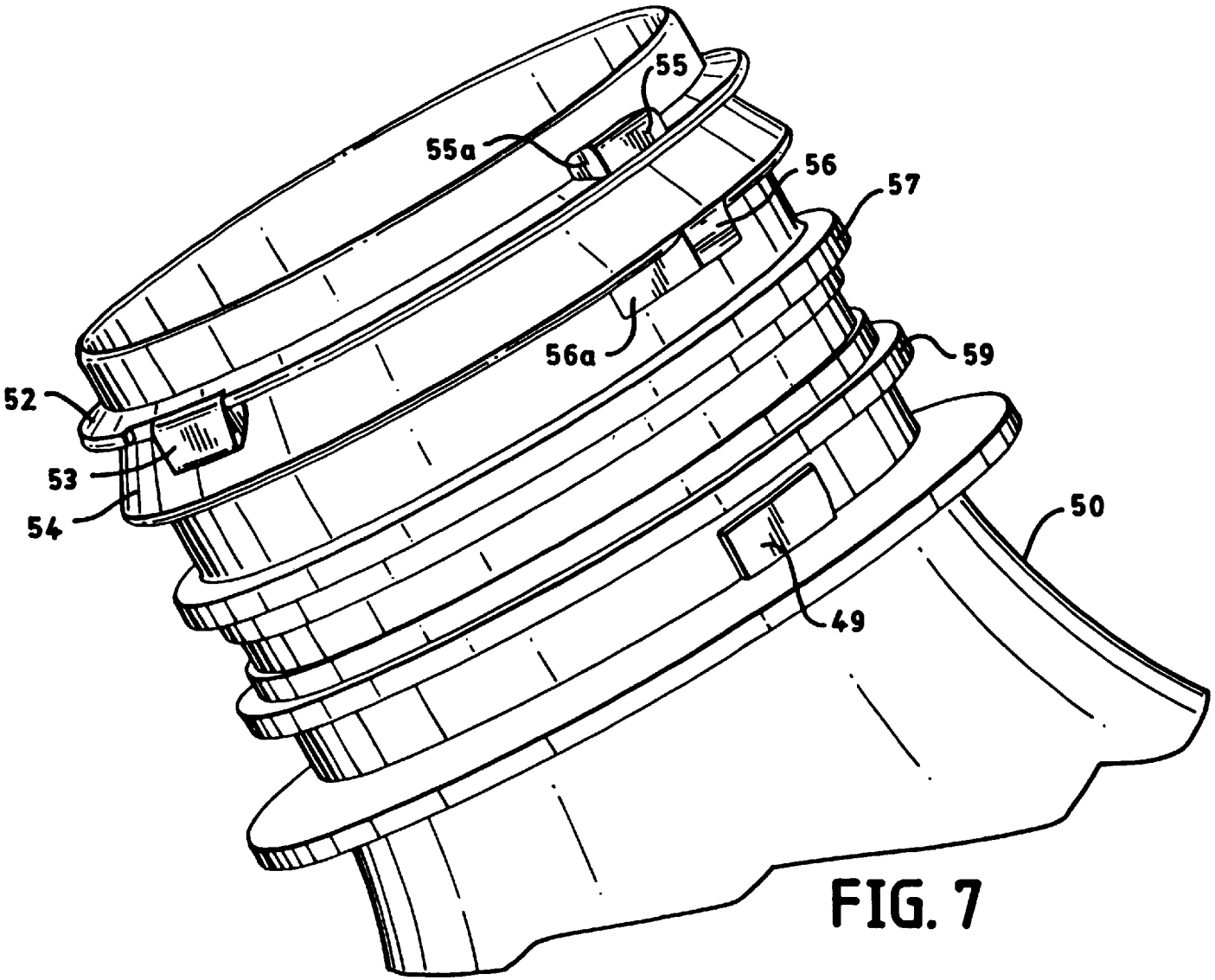
FIG. 7 is a perspective view of the container on which the dispensing cap, shown in FIG. 1 is attached.
Figure 8:
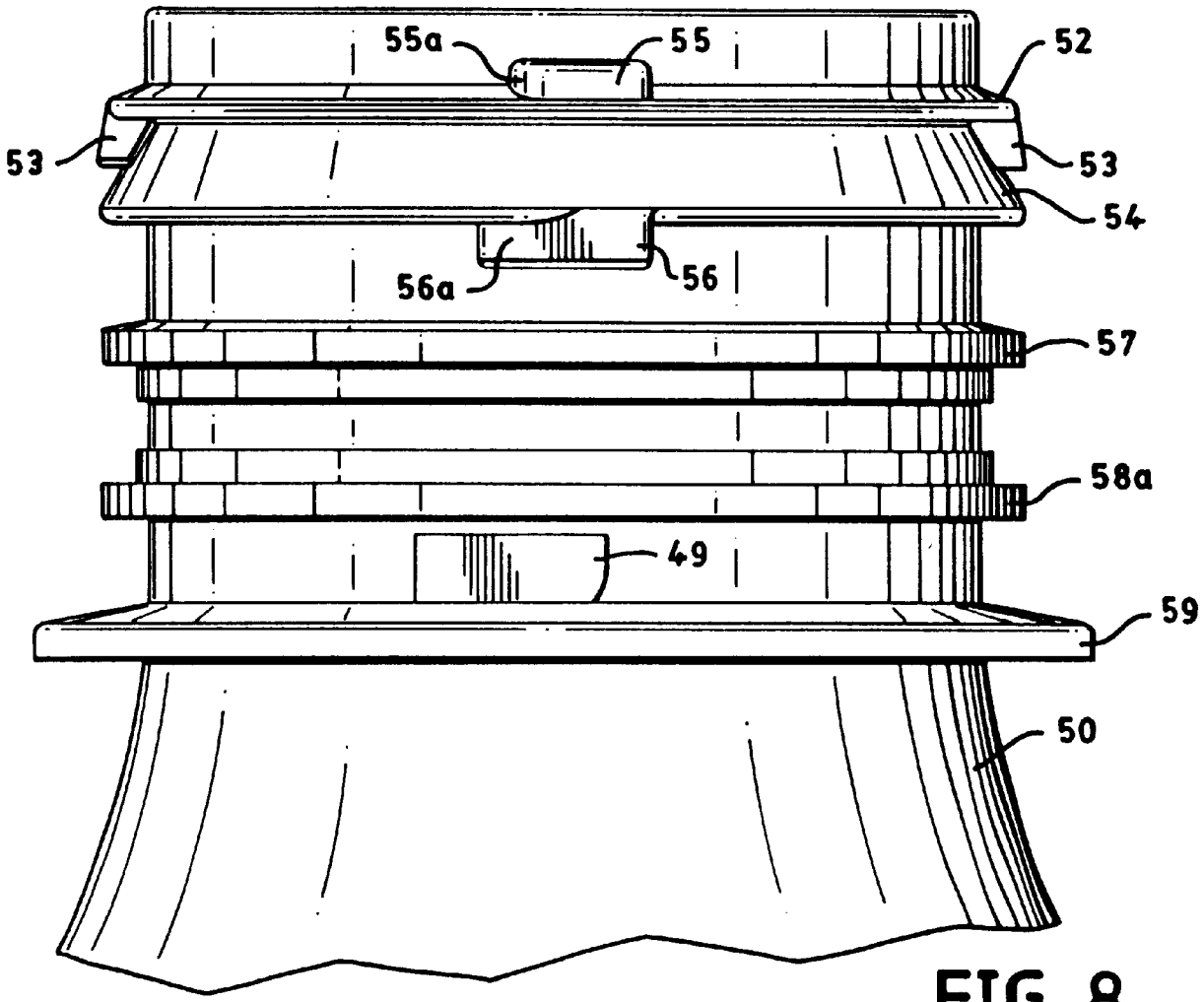
FIG. 8 is a side view of the container shown in FIG. 7.
Figure 12:
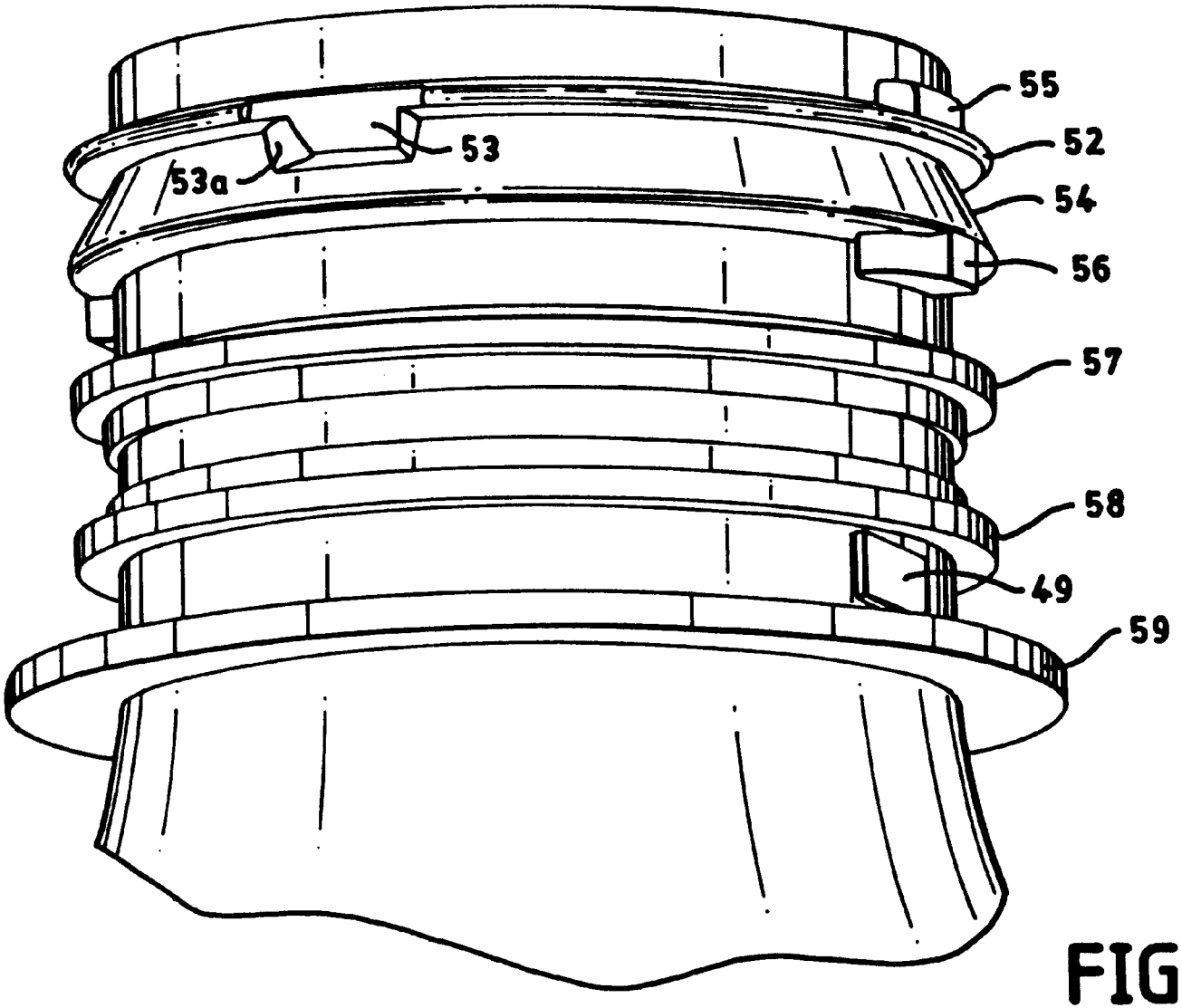

As partially shown in FIG. 2 in conjunction with FIG. 7 and FIG. 8, the two-stage dispensing cap for pressurized container 20 of the present invention is used in combination with a specialized container 50 which has three separately identifiable beads formed thereon working in conjunction with the dispensing cap 20. Annular upper bead 52 is provided along the upper portion of the container neck which is directly adjacent and above annular lower bead 54. Below said lower bead 54 is retaining bead 57 which firmly holds collar 40 and thus the cap 20 on the neck of container 50. Finally, annular tamper indicating or TI bead **58*a* or 58, shown in FIG. 8 and FIG. 12, is located below the retaining bead 57, TI bead 58*a* or 58 holding the tamper indicating band, if one is used, to the container neck once separated from the dispensing cap 20**.

Upper bead 52 is depicted as fairly narrow while, lower bead 54 has a more chamfered profile and is located directly there below. Both beads 52 and 54 are slightly angled on the downward direction such that their upper surfaces aid in the re-closing of the cap 20 onto container 50. Downward pressure may be utilized to snap the entire cap 20 over the beads and firmly onto the neck of container 50. Additionally, retaining bead 57 is further shown below said lower bead 54. Lower bead 54 utilizes a more chamfered profile as it is the main locking bead holding the flip top closed in the fully sealed position by retaining lug 28 below the lower edge of bead 54.

Figure 3:
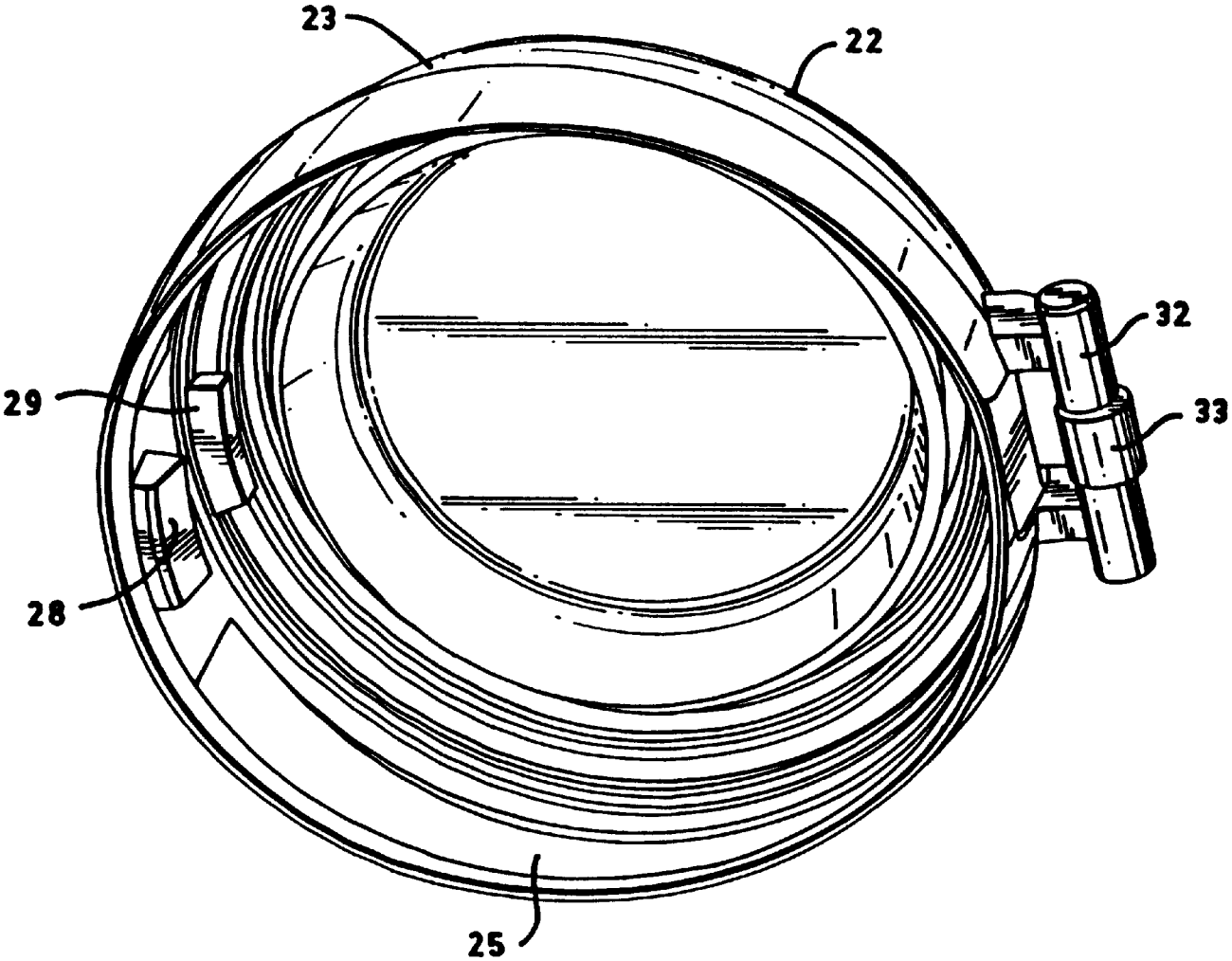
FIG. 3 is a lower perspective view of the flip top depicted in the dispensing cap shown in FIG. 1.

In addition to the construction of the beads on the neck of container 50 are primary cams 55 and 56 as well as secondary cam 53, shown in FIG. 7. The two stage latching action for the dispensing cap 20 of the present invention is caused by interaction of the lifting lug 29 on upper cam 55 when the cap 20 is rotated. Primary upper cam 55 acts to force the flip top 22 partially upward in order to vent the pressurized contents of the container 50 without fully releasing the flip top. Primary lower cam 56 deforms the flip top 22 in the outward direction by cooperating with the lid retaining lug 28 shown in FIG. 3. Flip top 22 at this stage is thus partially opened with lid retaining lug 28 locked underneath upper bead 52 preventing the complete opening of the flip top 22.

Secondary cam 53 completes the opening process of the flip top 22 after continued counter clockwise rotation of the collar 40 by forcing the lid retaining lug 28 over the upper bead 52. As is readily apparent from FIG. 2 and FIG. 9, retaining bead 57 combines with retaining collar 40 through retainer lugs 48, more clearly shown in FIG. 5, in order to allow easy rotation of collar 40 through on the neck of container 50 while firmly retaining the collar 40 and therefore the flip top 22 thereon. A further discussion of the interaction between primary upper cam 55, primary lower cam 56, secondary cam 53, upper bead 52, lower bead 54 and the lugs formed on the inner side wall of the flip top 22 will be discussed below.

Figure 4:
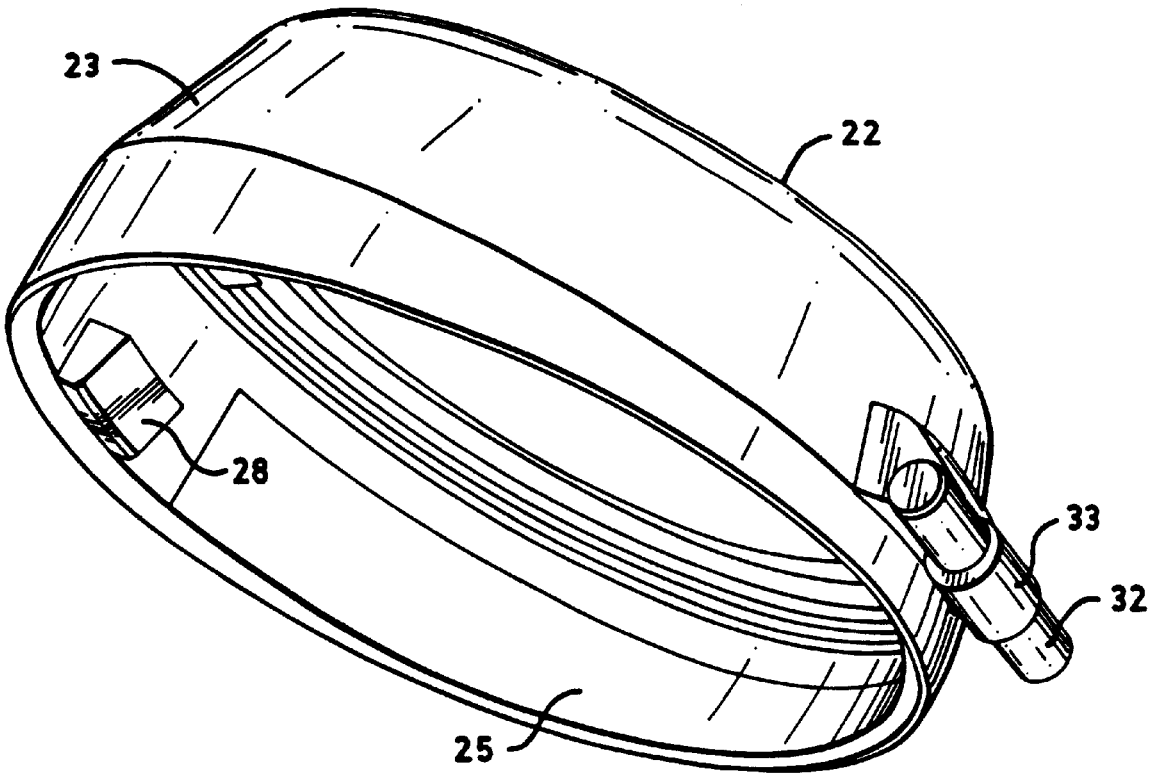
FIG. 4 is an additional perspective view of the flip top shown in FIG. 3.
Figure 5:
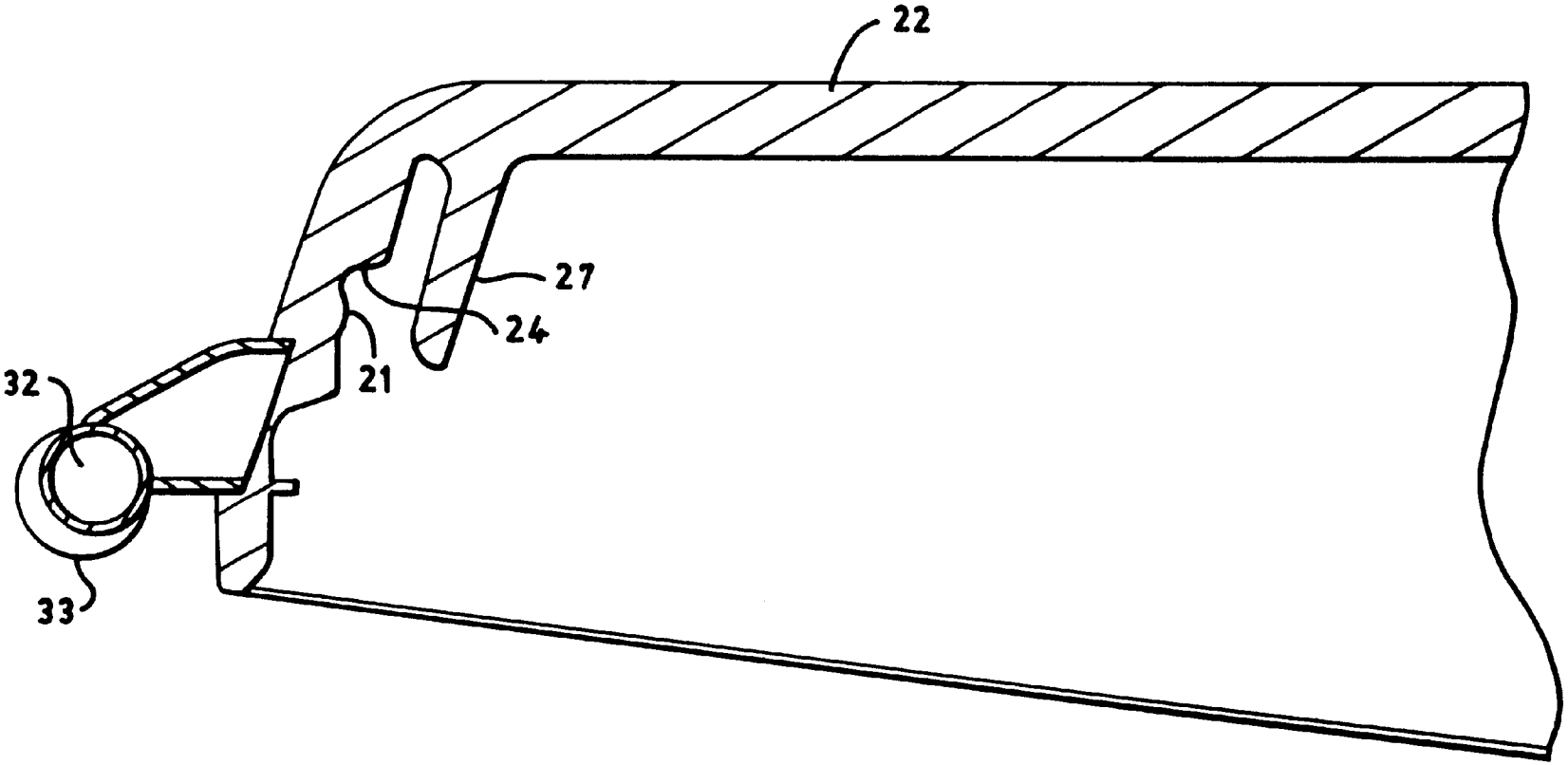
FIG. 5 is an enlarged partial cross sectional view of the hinge area for the flip top shown in FIG. 4.
Figure 6:
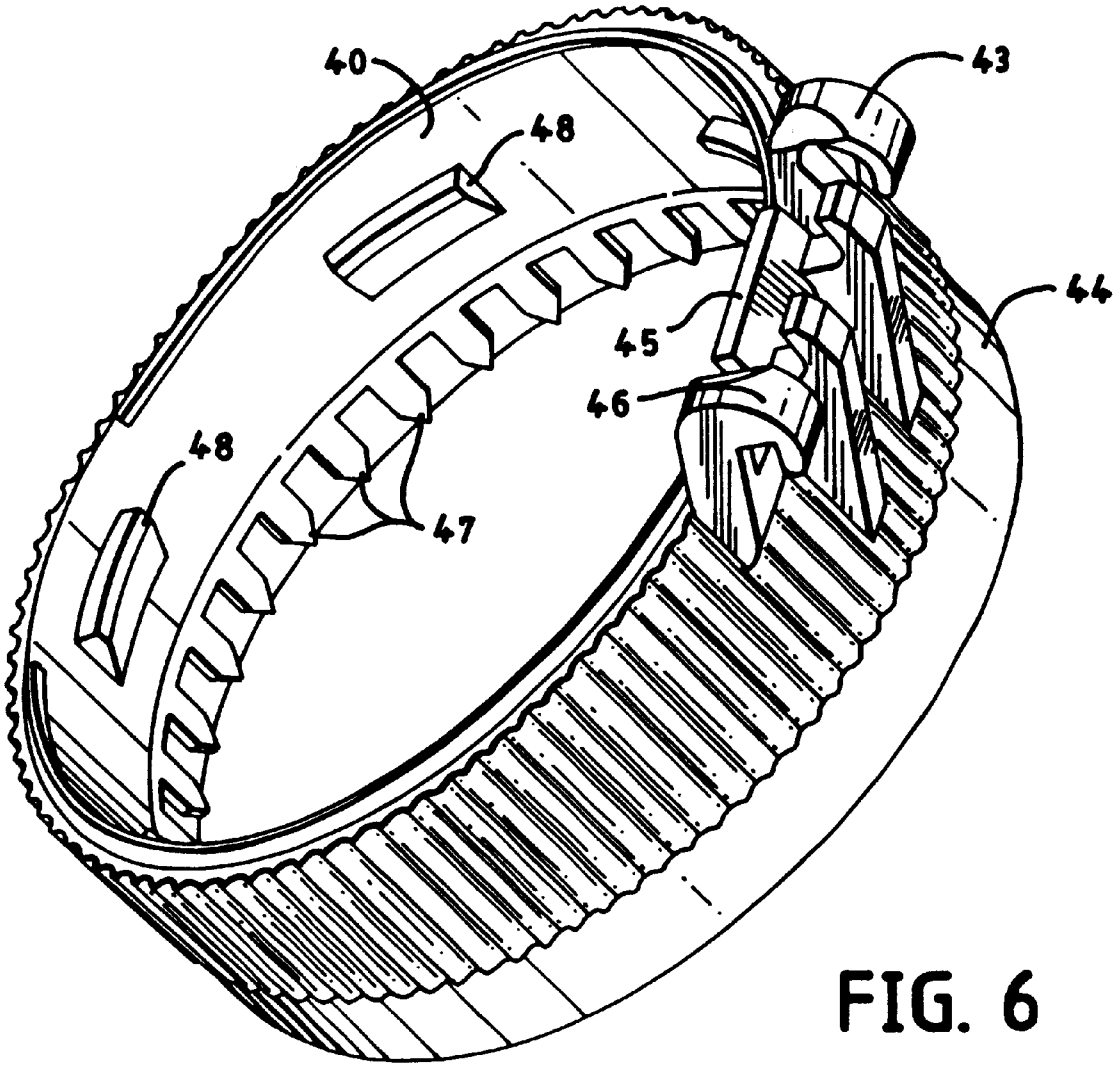
FIG. 6 is a perspective view of the collar portion of the dispensing cap for the present invention which is shown in FIG. 1.

Flip top 22 is further comprised of hinge post 32 which is rotatably received and retained within first hinge arm 43 and second hinge arm 46 of collar 40, shown in FIG. 6. The hinge post 32 of the flip top 22 has centrally located thereon a hinge eccentric 33 in order to bias the flip top 22 in the open or closed direction. The eccentric 33, more clearly depicted in FIGS. 4 and 4*a*, reacts with the hinge biasing tab 45 formed in between the first hinge arm 43 and second hinge arm 46 along the top edge of collar 40. Thus, the flip top 22 is biased by the action of the tab 45 on eccentric 33 biasing the flip top in the open or closed position. As can be seen in FIG. 5, the eccentric 33 expands slightly along an arc from approximately 90° moving clockwise to approximately 220° with the widest point being half way therethrough. By forming the eccentric in such a tapered arc, proper biasing of the hinge allows for compression of biasing tab 45 on the hinge when the flip top 22 is not in the proper open or closed position.

Returning to FIG. 3 also shown opposite the hinge on the interior portion of the side wall 23 is lift lug 29 and lid retainer lug 28. Lid retainer lug 28 is formed on the lower portion side wall 25 as it tapers from a thin cross section adjacent the hinge post 32 to a wider section directly opposite therefrom. The lid retainer lug 28 is located directly below lifting lug 29. Lifting lug 29 and lid retainer lug 28 work in conjunction with primary upper cam 55 and primary lower cam 56. In order to open the two-stage dispensing cap 20 of the present invention, the collar 40 and flip top 22 must be rotated in the counter-clockwise direction. Rotation of the collar 40 and flip top 22 causes lifting lug 29 to contact primary upper cam 55, shown in FIG. 7 along the top edge of upper bead 52. Primary upper cam 55 has a ramp 55*a* which forces the side wall 23 of flip top 22 in the outward direction by camming action on lifting lug 29. Concurrently, rotation of collar 40 and flip top 22 causes lid retaining lug 28, which when the dispensing cap 20 is in the closed position rests underneath lower bead 54, forcing lid retainer lug outward as it rides over primary lower cam 56 along the slopped ramp portion 56*a* as can be seen. These two actions work concurrently, both pushing the flip top 22 upward and outward by action of cams 55 and 56 on lugs 29 and 28 respectively. Lug 28 thus is allowed to ride over lower bead 54 and come to rest between upper and lower bead 52 and 54. Lug 29, which is not retained under upper bead 52 when the flip top 22 is in the closed position on collar 40, also moves slightly upward, its job merely to provide the lifting force necessary to release the lid retaining lug. Further, flip top 22 may also be forced upward without actuation of the primary upper cam 55 interacting with lifting lug 29. The internal pressure of the container will force the flip top upward during this turning motion whereby retaining lug 28 passes over lower cam 56 putting the flip top 22 in the partial open position and venting position shown in FIG. 9.

To provide additional sealing of the container and thereby ensure the proper containment of the pressurized contents, seal 21 is also formed above the lifting lug 29 as can be seen in FIG. 5. Seal 21 extends inward to contact the upper side wall of container 50 to adequately seal the container. Other sealing type configurations may also be utilized.

As shown in the figures, both the primary upper cam 55 and primary lower 56 are in the same location or are co-aligned on the neck of container 50. The flip top 22 is acted upon by both an upward force, caused by primary upper cam 55, and an outward force, caused by primary lower cam 56. These cams are shown more clearly in FIG. 8 in conjunction with the secondary cam 53, both of which are formed 90° apart. Likewise, primary upper cam 55 and primary lower cam 56 may be mirrored on the neck of container 50 by placement of a second set at approximately 180° from the ones depicted in FIG. 8. However, the primary cams 55 and 56 need not necessarily be co-aligned on the container neck. As long as the corresponding lugs 28 and 29 are separated by the same angle as that which may separate the primary uppers cams 55 and 56, the double latch flip seal dispensing closure 20 of the present invention will work appropriately.

Figure 9:
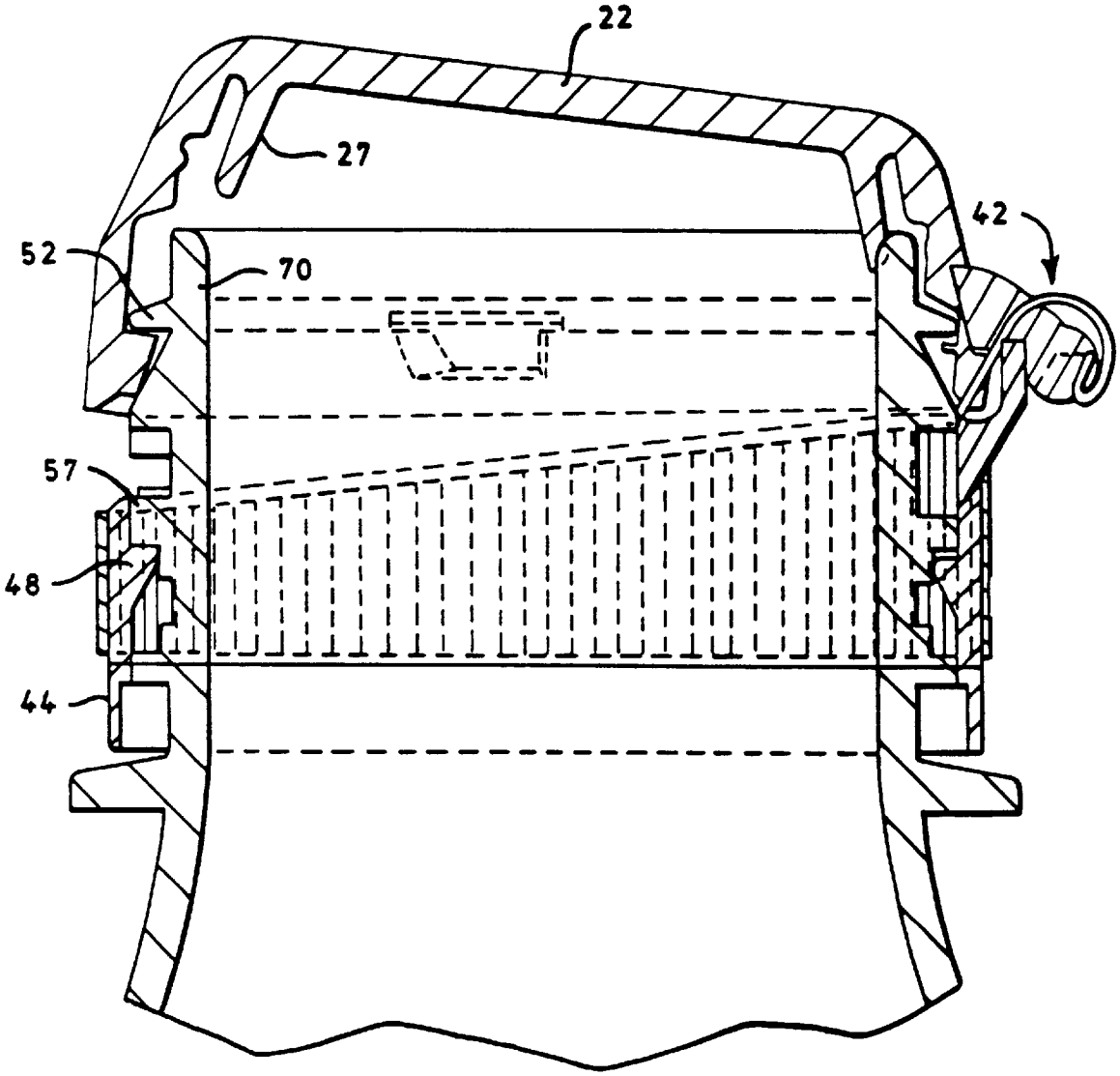
FIG. 9 is a partial sectional view of the dispensing cap shown in FIG. 1 attached to the container and which is partially opened upon initial rotation of the two stage closure.
Figure 10:
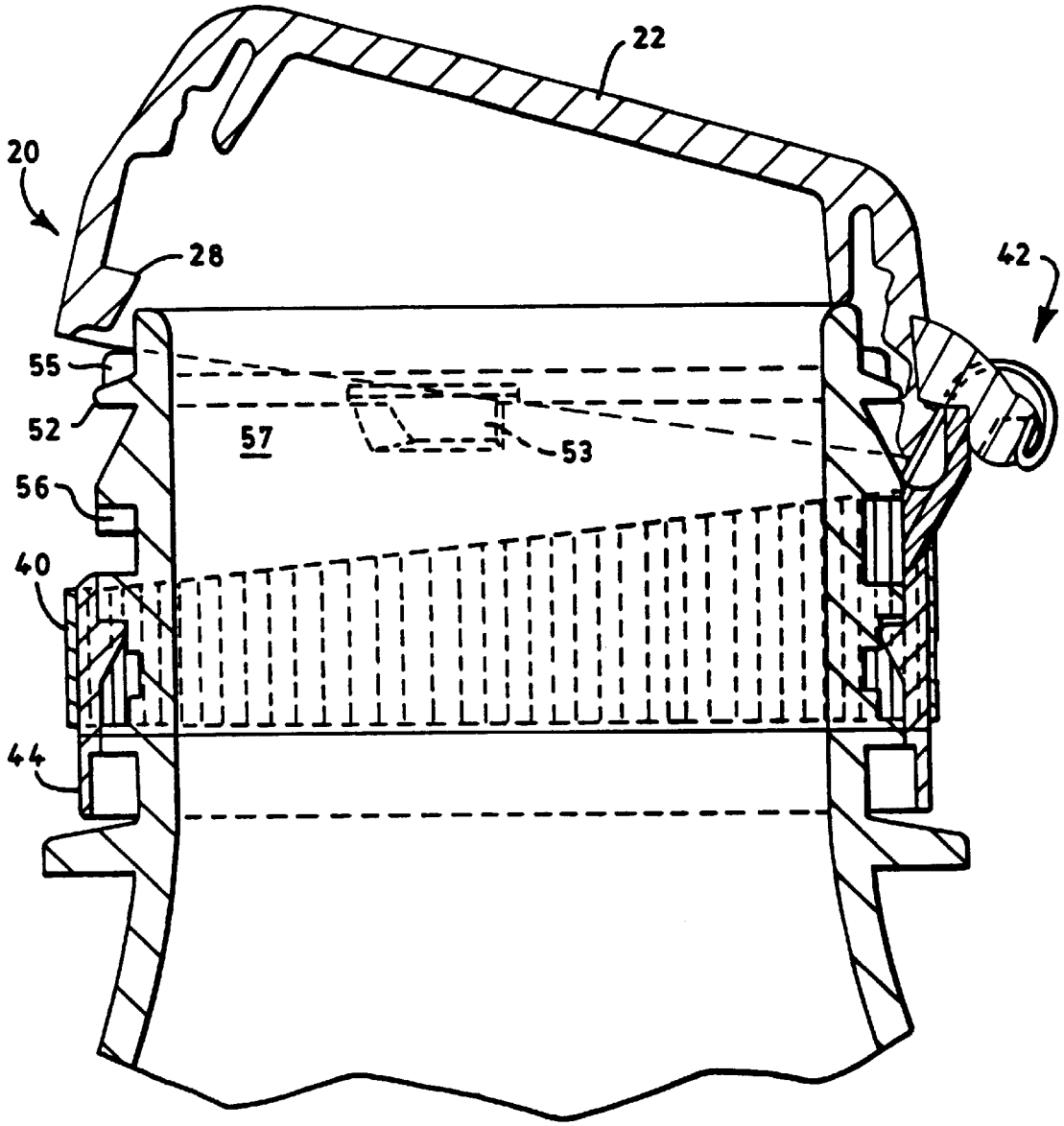
FIG. 10 is a partial sectional view of the dispensing cap shown in FIG. 9 wherein the flip top is opened after further rotation of the cap.

Primary upper cam 55 and primary lower cam 56 force the flip top upward and outward, but their combined action does not allow the lid retaining lug 28 over the upper bead 52. Thus, when the dispensing cap 20 of the present invention is rotated causing the lugs 28 and 29 over cams 55 and 56, respectively, the flip top 22 is retained on the neck of container by upper bead 52 interfering with and retaining lid retainer lug 28. This can be readily seen in FIG. 9 wherein the lugs 28 and 29 have been rotated past cams 55 and 56. Thus, as is shown in FIG. 9, the flip top 22 is retained on the neck of container 50 allowing venting of the pressurized gas within container 50 while further preventing the flip top 22 and hinge 42 from rotating to the fully open condition displayed in FIGS. 10 and 11. The closure shown in FIG. 9 is thus depicted in the first stage of opening without the flip top 22 being allowed to continue rotation about hinge 42. As depicted in FIG. 9, venting of the contents of container 50 occurs while the flip top 22 remains in the partially open but locked position.

Continued counter-clockwise rotation of the collar 40 in conjunction with flip top 22 causes the lid retaining lug 28 to pass directly over the secondary cam 53 which is depicted in FIG. 7 and FIG. 8. The secondary cam 53 which has a similar ramp portion 53*a*, is located along the bottom edge of the upper bead 52. The upper bead 52 retains the flip top 22 in the locked, but partially open position, by preventing lug 28 from rising over bead 52. As the dispensing cap 20 and flip top 22 of the present invention is rotated in the counter-clockwise direction, the secondary cam 53 causes lid retaining lug 28 to rise over the upper bead 52 and release the flip top 22 from the partially open but locked position depicted in FIG. 9.

Figure 11:
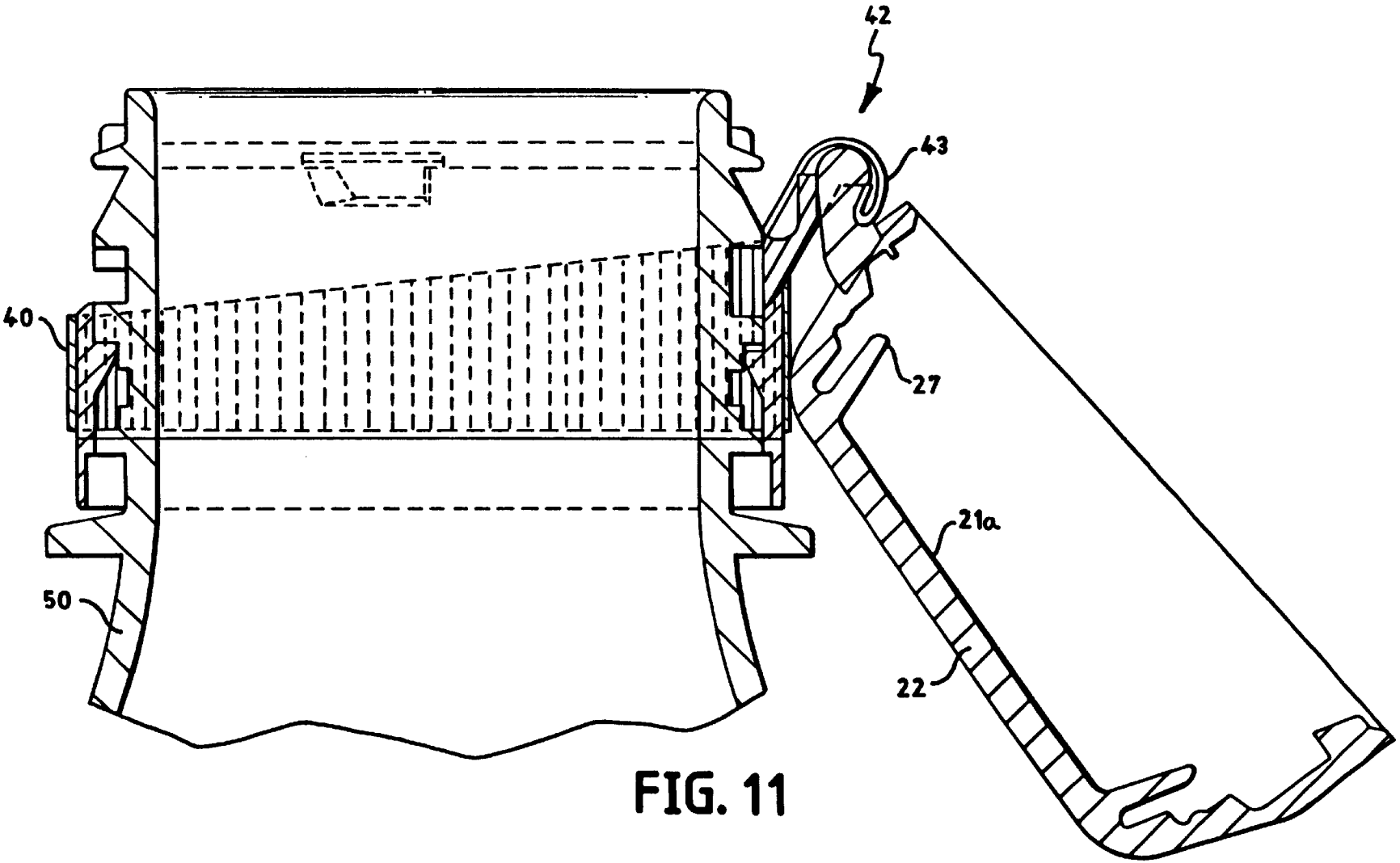
FIG. 11 is a partial sectional view of the dispensing cap and closure shown in FIG. 9 with the flip top completely open; and, FIG. 12 is a lower perspective view of the container for use with the closure of the present invention wherein the tamper indicating features are shown.

Secondary cam 53 has a ramp portion 53*a*, shown in FIG. 9 to aid in allowing clearance of the lid retaining lug 28 over the upper bead 52 which is holding the flip top 22 in the partially closed and locked position. Secondary cam 53 as depicted is located at 90° from the primary upper cam 55 and primary lower cam 56 but may be located in a number of functionally equivalent but varying rotational positions. A second secondary cam may be located at 180° from the secondary cam depicted in FIG. 7 and is shown in FIG. 8. Thus, as displayed in FIG. 10, continued rotation of the cap 20 forces lid retaining lug 28 over upper bead 52 allowing the flip top 22 to rotate about hinge 42. The contents of the container 50 may then be dispensed, as is shown in FIG. 11, by fully rotating the flip top to the dispensing position.

As shown in FIG. 5, the flip top 22 of the present invention is provided with a double seal mechanism, depending annular seal 27 and inwardly directed seal bead 21. Both seals provide a means to prevent leakage of the high pressure gas from the container once the dispensing cap 20 of the present invention is placed in the fully closed and locked position. Annular depending or plug seal 27 may extend downward from the top wall of the flip top 22 in order enter into the neck or mouth of container 50 and compress against the inner wall thereof. A tight compressive fit is provided between plug seal 27 and the interior wall of the container 50. Additionally, as the flip top 22 is made of a hardened plastic material, inwardly directed sealing bead 21 contacts the outer neck wall of the container 50 to provide additional sealing mechanisms. Further, as is shown in FIG. 2 in combination with FIG. 5, recess 24 receives the lip portion of the container mouth. These mechanism act to positively seal the high pressure contents of the container 50.

One benefit of the design for the flip top 22 of the present invention becomes evident from the capping operation necessary for the closure 20. It is important to assure proper alignment after capping such that the orientation is consistent and thus that the tamper indicating ratchets 49 are in alignment with respect to tabs 47 on collar 40, shown in FIG. 6. Capping of the closure 20 constitutes pushing down on the closure and turning it clockwise such that the lid lugs come to a stop against the front square portion of primary cams 56 and 55.

Turning to FIG. 6, the dispensing cap 20 of the present invention has retaining collar 40. The collar is comprised of a plurality of collar retaining lugs 48 which are on the interior of the side wall of collar 40 and preferably six are equally spaced around the interior side wall. Collar retaining lugs 48 retain the dispensing cap 20 on the container neck by being snap fitted over retaining bead 57 in the position which is shown in FIGS. 2 and 9.

As is apparent from FIG. 9, while the retaining bead 57 holds the collar 40 and thus the entire dispensing cap 20 on the container 50, free rotation of the collar 40 about the neck of container 50 is allowed. Such free rotation of the collar 40 is a requisite for proper working of the cap 20 design since the lifting lug 29 and lid retainer lug 28 and the cam surfaces which actuate the lugs, namely, upper cam 55, lower cam 56 and secondary cam 53, necessarily require interaction.

The structure of the presently described double latch flip top dispensing closure for pressurized containers can prevent the user from closing the flip top in the opening position. Thus, if the lift lug 29 is co-aligned on the container neck with primary upper cam 55 the top 22 is prevented from closing due to the lift lug 29 hitting upper cam 55, lug 29 being unable to override cam 55 by simple downward pressure on the flip top. However, at any other rotational orientation, the lug and cams will not interfere and the double latch flip top will be allowed to close.

Figure 13:
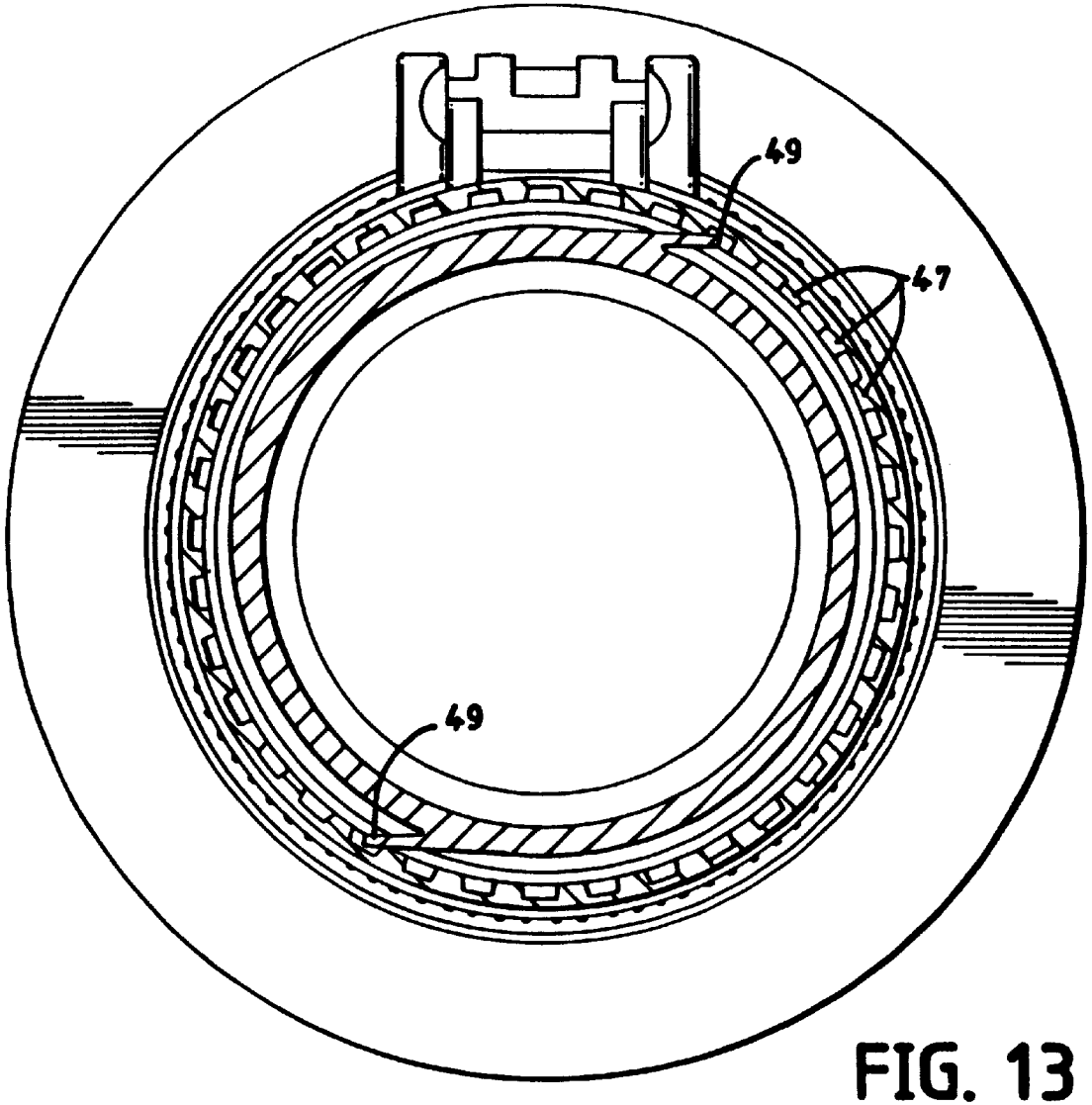
FIG. 13 is a top view of the closure and container of the present invention detailing the interactivity of the tamper indicating feature.

Additionally shown in FIG. 6 is the tamper indicating band 44 wherein a plurality of webs connect the band 44 to the lower edge of the side wall of collar 40. In the inner wall of tamper indicating band 44 are located a plurality of tabs 47 designed to frictionally engage outwardly extending ratchets 49, shown in FIGS. 12 and 13. Upon capping of the two stage dispensing closure 20 of the present invention, tamper indicating band resides below TI bead 58 and the plurality of tabs 47 interact with ratchet 49 to prevent rotation of the TI band 44. Annular shoulder 59 is provided for a base onto which the tamper indicating band becomes compressed against during the capping operation and may represent the maximum downward movement allowed for the flip top cap 20. When the flip top is opened in the first instance by rotational pressure being applied, TI band is prevented from similarly being rotated and thus the band 44 becomes detached form the collar 40 and is plainly visible to the use. Many other standard tamper indicated features are well within the design capabilities of one having ordinary skill in the art.

As shown in FIG. 8 and as discussed above, there are two pairs of the primary upper cam 55 and primary lower cam 56 formed on the neck of container 50. Further, two secondary cams 53 are apparent. Each of the sets of cams are formed 180° apart. Upon initial assembly of the dispensing cap 20 the lugs 28 and 29 formed on the interior of side wall 23 on the flip top 22 are placed between the secondary cam 53 position on the neck and the primary cam positions 55 and 56 on the neck of container 50. Thus, initial rotation of the dispensing cap 20 causes the primary cams 55 and 56 to first act upon the dispensing cap 20 when the cap is turned counter clockwise.

As shown in FIG. 11, the flip top 22 is shown in the fully open position wherein hinge 42 has allowed the flip top 22 to rotate in excess of 180°. Top wall 21*a* has contacted the side wall of collar 40 preventing continued rotation about the axis of hinge 42. The flip top 22 is in the completely open position allowing full dispensing of the contents within container 50 without interference from the dispensing cap 20. Hinge arms 43 and 46 prevent the hinge post 32 from being removed, thus retaining the flip top 22 firmly to collar 40.

Figure 14:
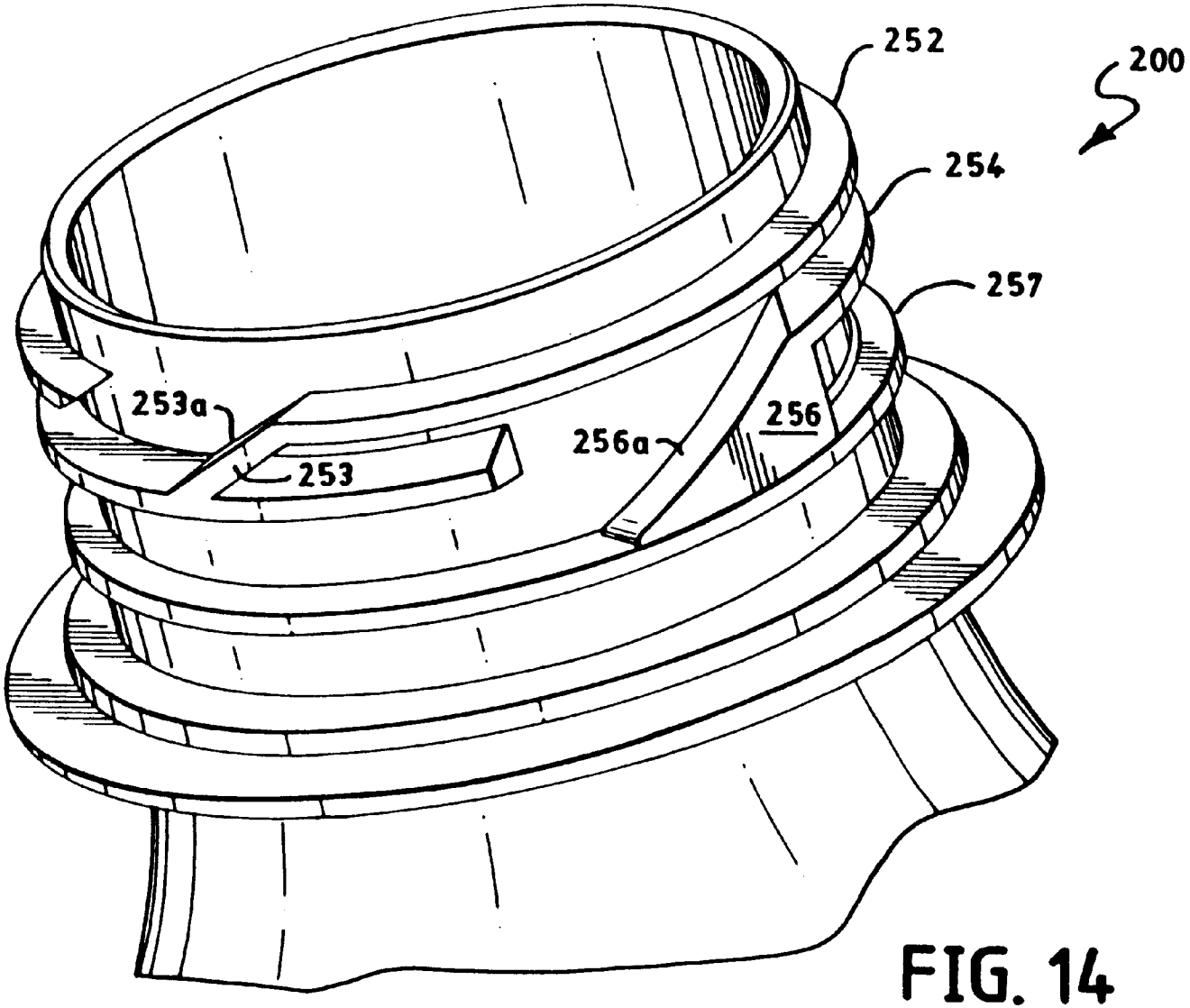
FIG. 14 is an alternative embodiment for the neck finish for use in combination with the double latch flip top of the present invention.

Turning to FIG. 14, an alternative embodiment for the neck finish 200 is detailed. As can be seen, the neck finish 200 is similarly comprised of an upper bead 252 and a lower bead 254 which work similarly to the upper and lower beads 52 and 54 of FIG. 8. Namely, lower bead 254 retains the flip top 22 in the closed position despite the prospects of the container being under high pressure. Retaining the flip top 22 in the closed position is completed by placement of the retaining lug 28 below the lower bead 254 after application of the closure 20 onto the container neck finish 200. As with the other embodiments, the closure 20 is opened by counter-clockwise rotation of the collar 40 which causes the lid retaining lug 28 to eventually contact ramp member 256*a* of lower cam 256. Thus, lower cam 256 in combination with ramp member 256*a* causes an upward force to be applied to the flip top 22 thereby allowing lid retaining lug 28 to over-ride the lower bead 254.

After continued rotation of the flip top 22, lid retaining lug 28 remains under upper bead 252 such that the double latch action of venting and then opening of the container is completed in separate steps. Thus, after lug 28 is placed in between lower bead 254 and upper bead 252, continued rotation causes the lug 28 to contact secondary cam 253 and secondary cam ramp member 253*a* thus releasing the lug 28 from under the bead 252 and allowing the flip top 22 to be in the fully opened and unlocked position.

Cam members 256 and 253 are shown in FIG. 14 as being somewhat adjacent but placement of the cams may be positioned on the neck finish 200 in such a position that actuation of actual opening of the flip top 22 via secondary cam 253 occurs after lifting of the lug 28 over the lower bead 254. The distance between these two actions may be adjusted by placing two primary cams 256 at various positions, typically at 180 degrees apart. Similarly, secondary cam 253 may shadow primary cams 256 and be placed just before the cam, on a counter-clockwise rotational direction, as is shown in FIG. 14 or may be placed strictly at 90 degrees from each of the primary cam members 256, if more than one is utilized.

Similarly as in the neck finish previously described, retaining bead 257 is provided to retain the collar 40 on the container neck finish 200 but also allowing the flip top 200 to be fully rotatable thereon.

One benefit of the present inventive design is the primary releasing lower cam 56 is flush in diameter with the retaining bead. Thus, the lugs on the flip top 22 prevent closing the flip top in the "opening" position since they would hit the top of the upper bead and thus the lifting lug 55. This design provides therein a means to insure the proper closing orientation of the closure 20 in comparison with the neck of container 50.

Figure 15:
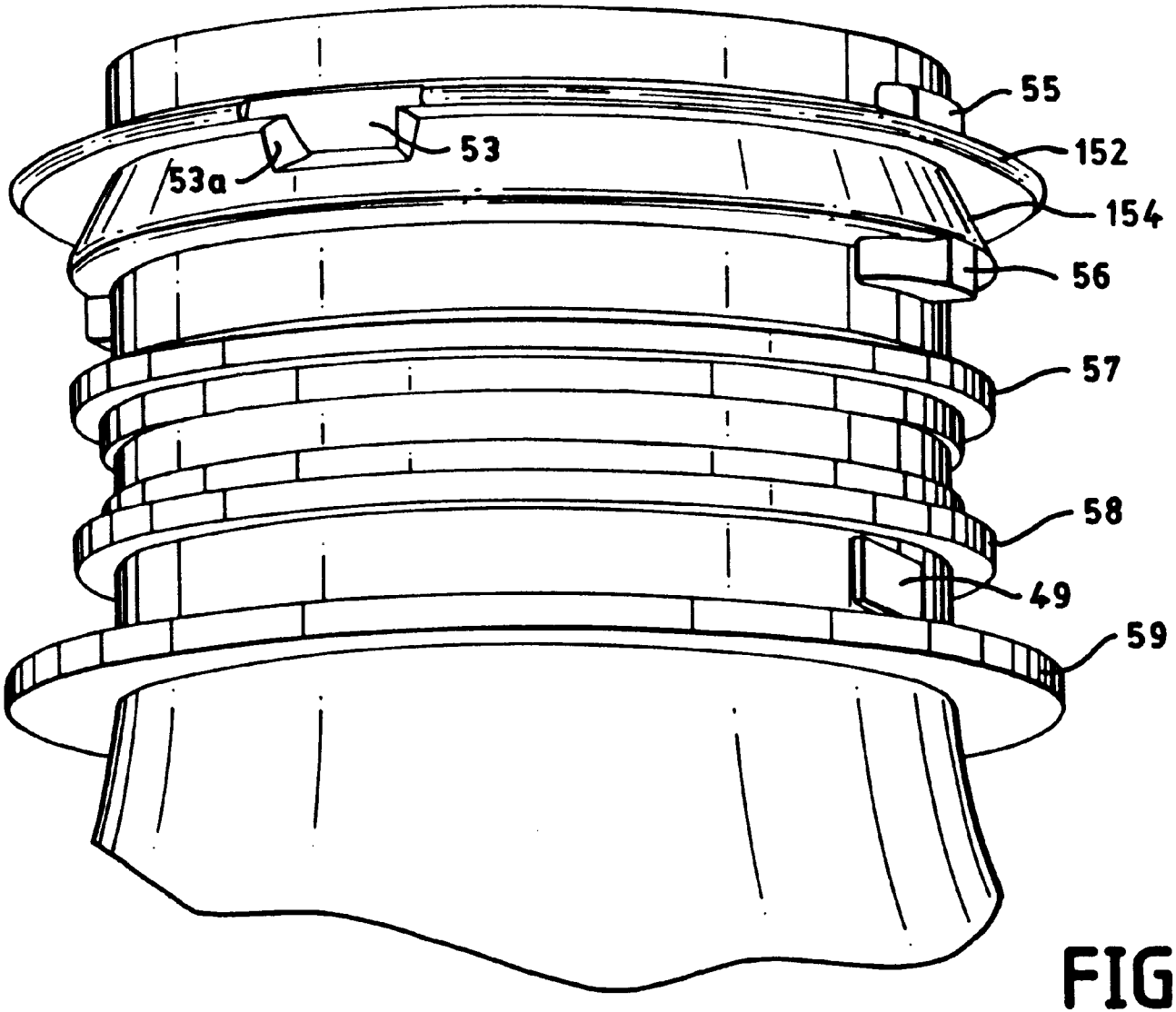
FIG. 15 is an alternative embodiment for the neck finish wherein the upper bead has a wider diameter than the lower bead.

Turning to FIG. 15, alternative neck finish 100 is displayed which will work in conjunction with the closure 20. In the embodiment disclosed therein, the finish is comprised of an upper bead 152 and a lower bead 154. As can be seen from the depiction, the upper bead 152 has a wider or deeper diameter than lower bead 154. The larger diameter of the upper bead is designed such that the upper bead will catch the flip top 22 upon initial opening of the closure. Thus, retaining lug 28 on flip top 22 is firmly retained under lower bead 154 when the closure 20 is in the fully 115 closed position. Upon initial opening by upward pressure, retaining lug 28 over-rides lower bead 154 and is caught by upper bead 152 in order to allow proper venting of the container. Upper bead 152 in this embodiment is thus designed to be deeper or have a larger diameter than the lower bead 154 in order catch the retaining lug as it is forced upwards during the opening action.

If the upper bead were of similar depth than the lower bead, a possibility exists that the retaining lug could be forced over the upper bead and the flip top opened completely in a single action instead of a two stage action intended. The actual diameter of the upper bead may vary but in this alternative embodiment it is only necessary that the upper bead be deeper than the lower bead so as to properly catch the retaining lug upon upward pressure of the flip top.

In addition to the bead diameter aspects noted above, the cams may be removed such that upward force by a user opens the flip top 22 and the retaining lug on the inner wall of the flip top interacts with the upper bead 152 to prevent complete opening thereof. Thus, upward force is applied by the user without the necessity of the cams along the bead surfaces. This action may be used to activate the double stage flip top closure of the present invention alone or in combination with the cams depicted.

It may also be desirable to segment both the upper and the lower beads as depicted in FIG. 15. By segmenting, it is meant that the bead not necessarily continue all the way around the container neck finish. Both beads could be intermittent with gaps being formed at regular locations. In such a design, it may therefor be necessary to insure that the gaps formed in the beads between bead segments have a peripheral length which is shorter than the peripheral length of the retaining lug on the flip top so that the retaining lug is not unintentionally released as it passes in the gap region between bead segments.

Figure 16:
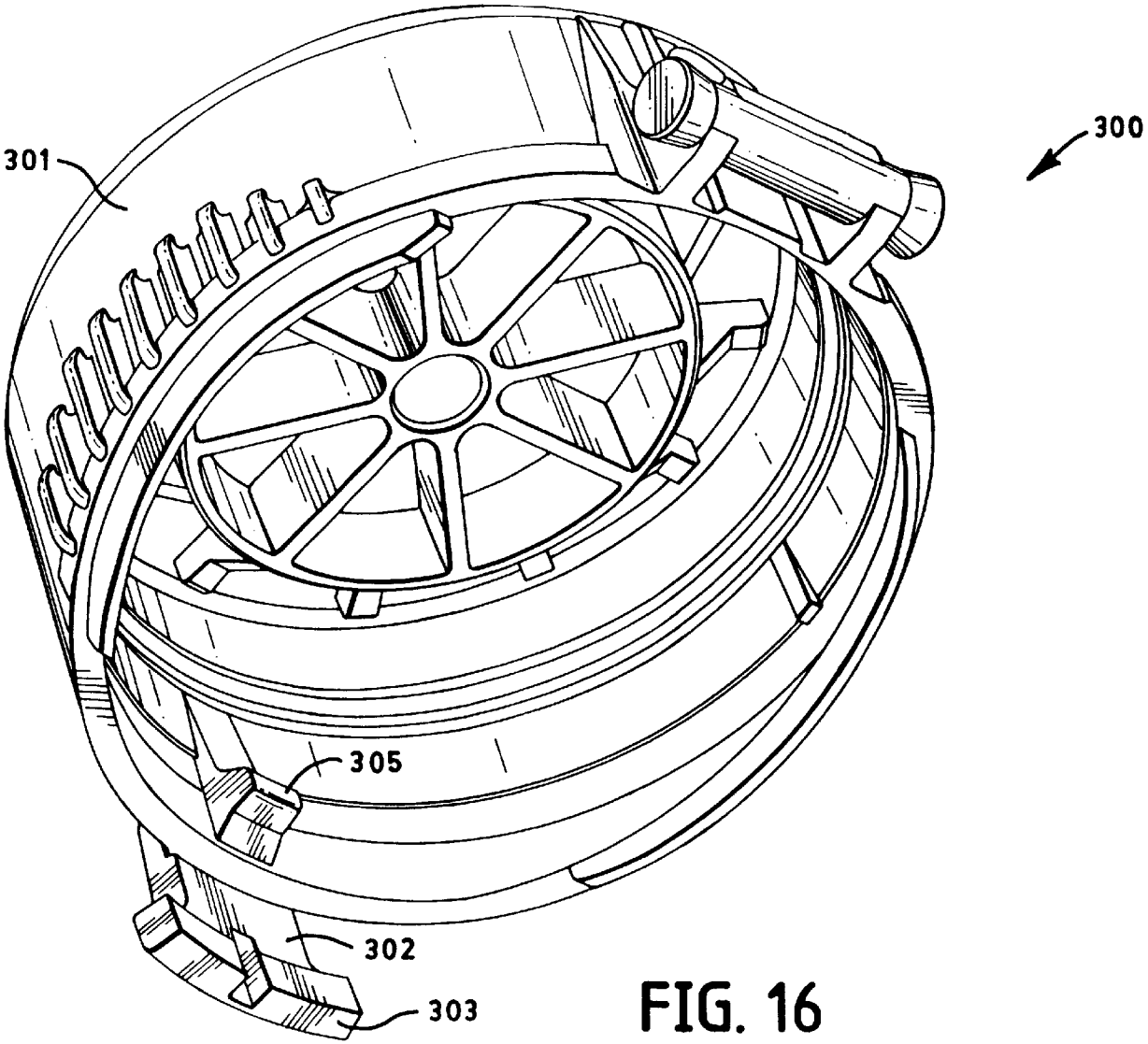
FIG. 16 is a lower perspective view of the flip top of the alternative embodiment.
Figure 17:
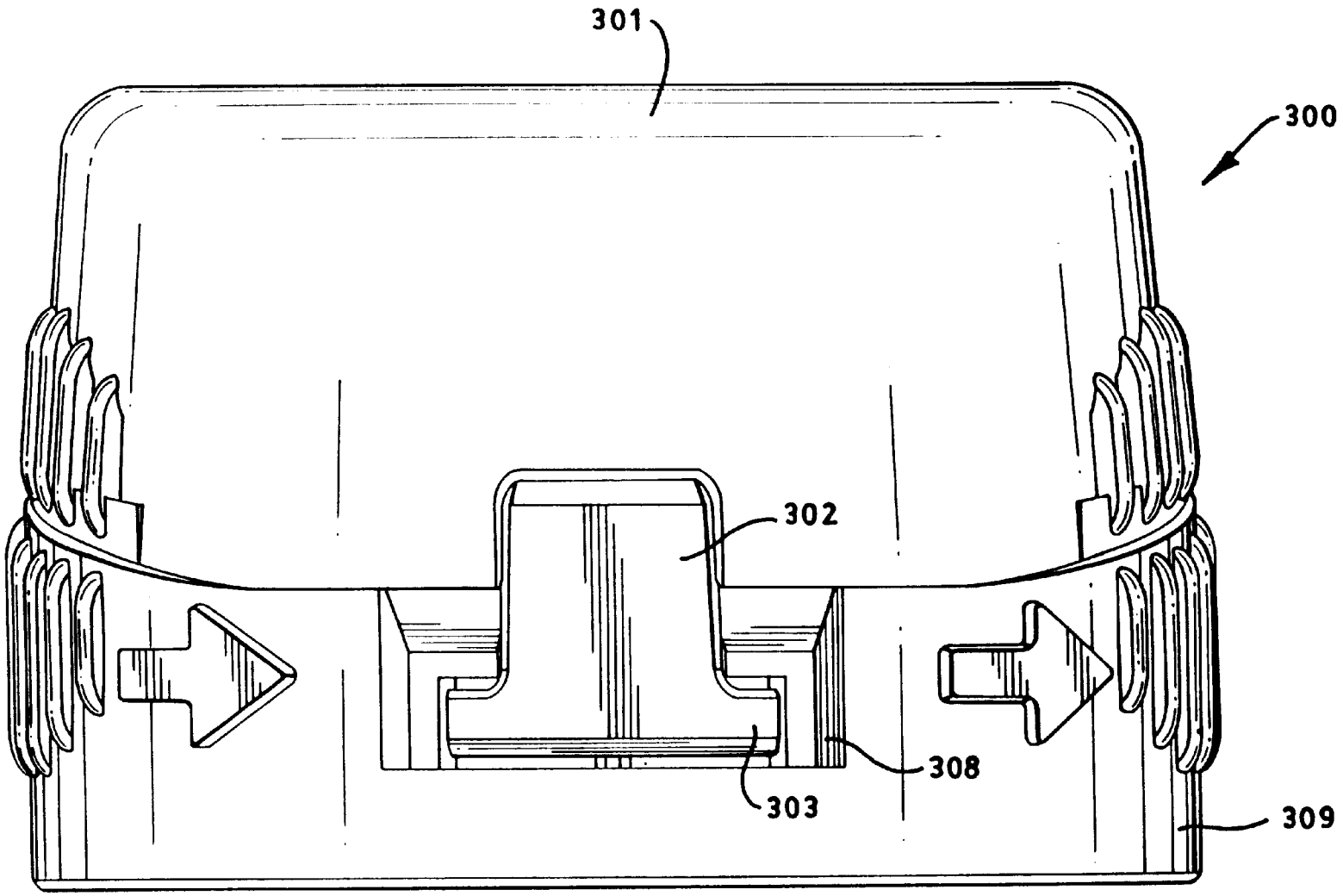
FIG. 17 is a front view of the flip top of FIG. 16.
Figure 18:
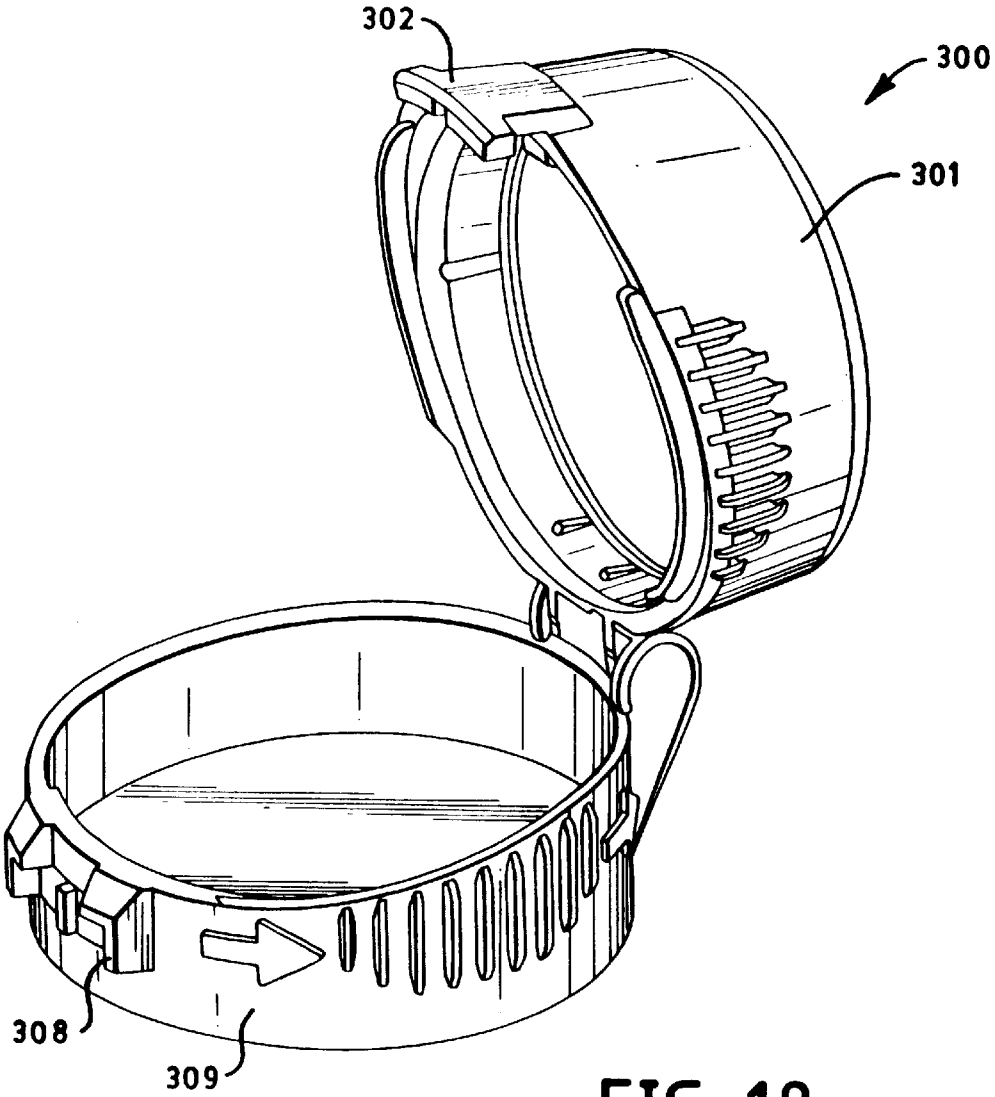
FIG. 18 is a perspective view of the open flip top of FIG. 16.

Turning to FIG. 16, an alternative flip top design 300 is shown. The flip top 301 is depicted in FIG. 16 wherein only a single retaining or lifting lug 305 is utilized. Retaining lug 305 as shown is directed inwardly from the depending side wall of the flip top 301. Working in conjunction with the retaining lug 305 is the depending T-Bar 302. In this design as is shown in FIGS. 16, 17 and 18, flip top 301 has T-Bar 302 depending therebelow which interacts with catch recess 308 formed in collar 309. Thus, in the closed position, the design 300 depicted will utilize two holding structures to maintain the closure in the closed position, namely the retaining lug 305 and the T-Bar 302 with retaining projections 303. Retaining lug 305 will be held below a retaining bead 320 shown in FIG. 19 and the T-Bar 302 will force the flip top 301 in the closed and locked position as is shown in FIG. 17. When the collar is turned counter clockwise, the neck finish depicted in FIG. 19 causes the T-Bar latch 302 to over-ride the recess 308 and be placed in the venting position. Primary lower cam surface 325 co-acts with retaining lug 305 causing the T-Bar latch 302 to be forced out of the recess and additionally causes the lug 305 to over-ride bead 320. Upper bead 322 will then catch the lug 305 to prevent further opening of the flip top 301. Extended peripheral projection 323 expands the diameter of the upper bead 322 to ensure that the lug 305 is maintained below upper bead 322 while in the venting position. Continued rotation of the collar portion 309 causes the lug to ride up cam surface 326 so that the flip top is in the fully open position as depicted in FIG. 18.

Figure 19:
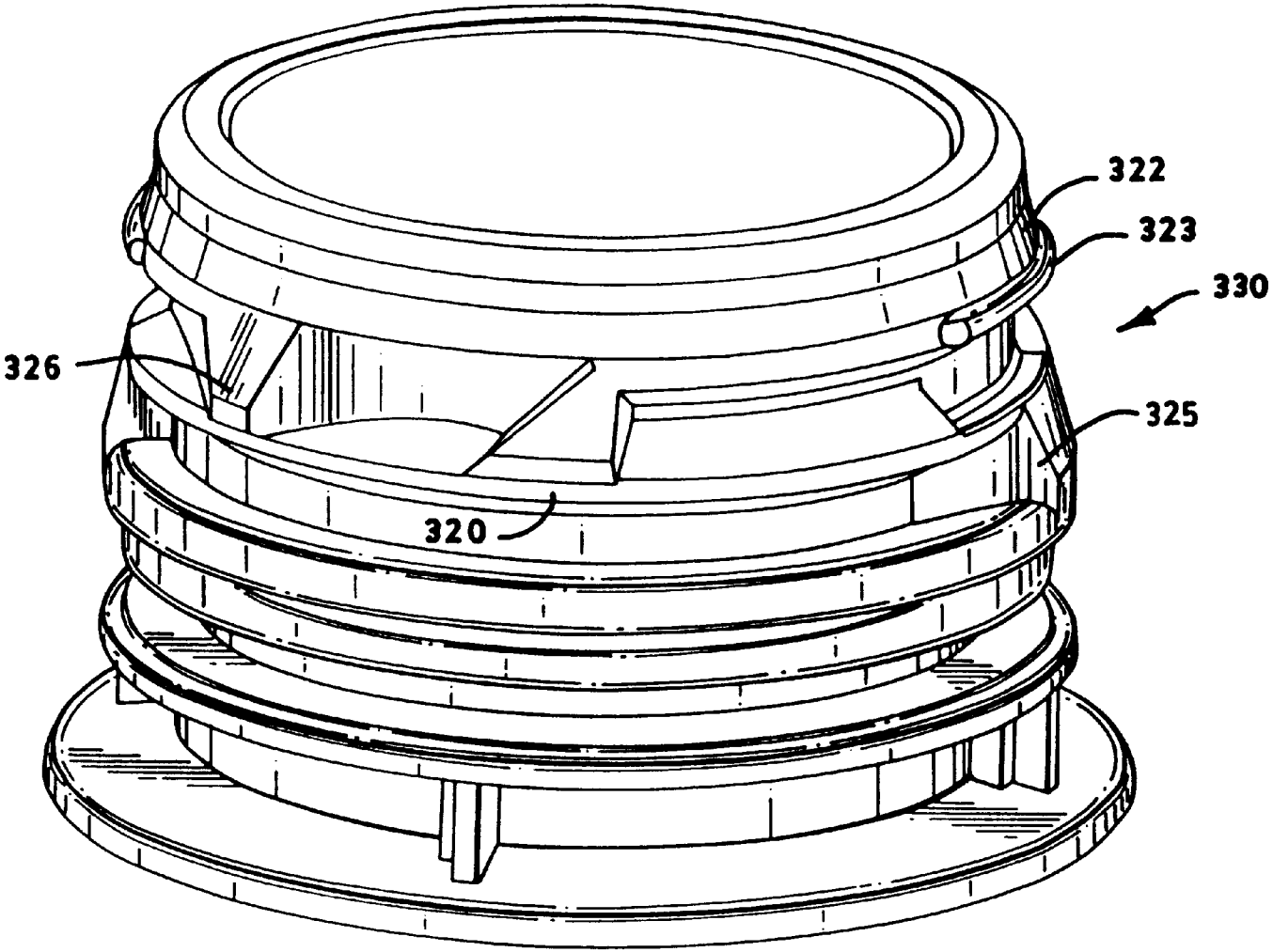
FIG. 19 is a perspective view of the neck finish for use with the flip top of FIG. 16.

Again, as detailed in prior embodiments, the neck finish shown in FIG. 19 may be mirrored so that there are two sets of cam surfaces 180 degrees apart. The design depicted with the T-Bar latch mechanism 302 may be desirable in that the latch 302 will maintain the flip top 301 in the closed position when under high pressure. Further, peripheral projections 323 shown work in similar fashion as the bead design shown in FIG. 15 thereby ensuring that the flip top maintains a two stage opening process.

Figure 20:
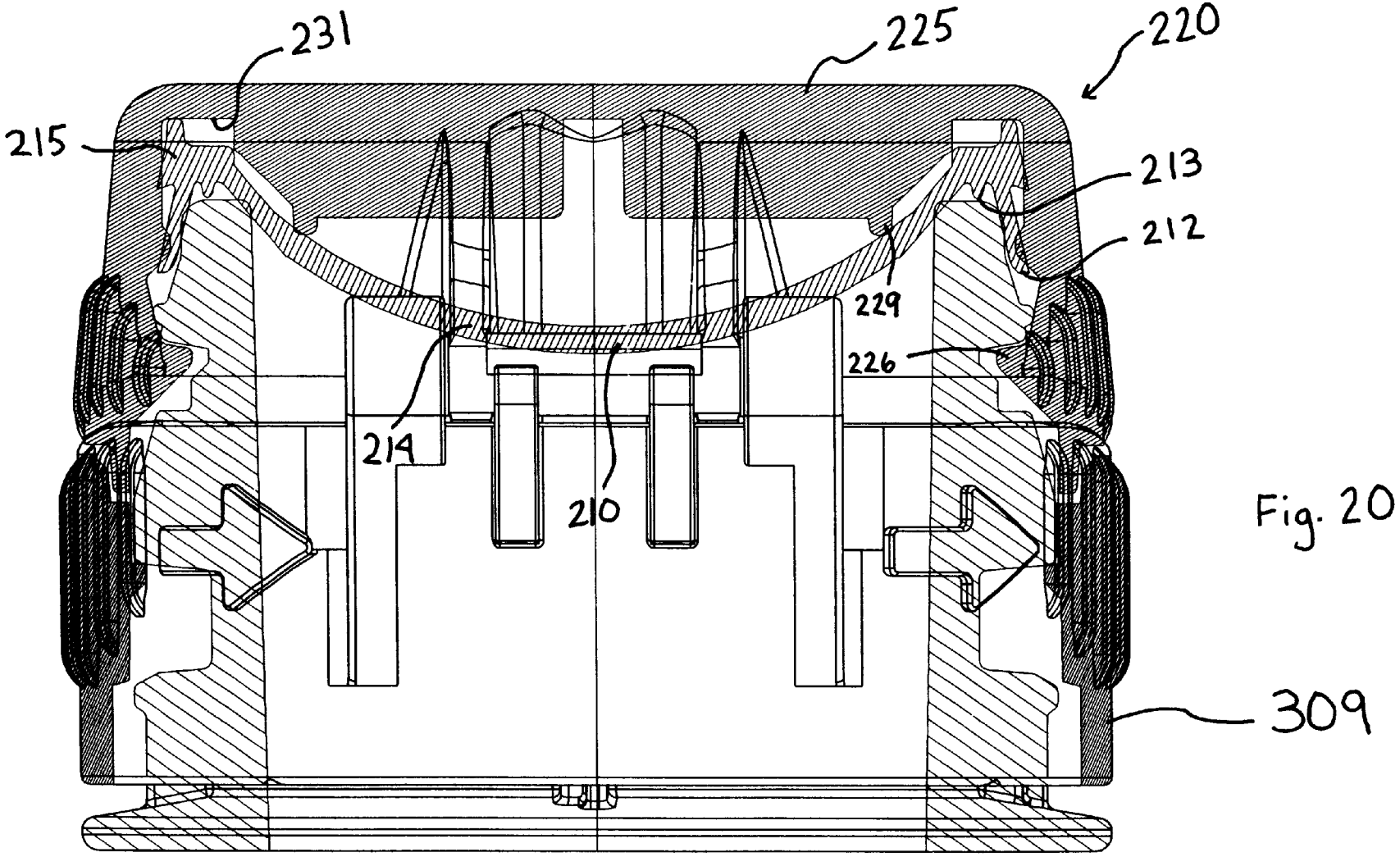
FIG. 20 is a partial sectional side view of the an alternative embodiment of the dispensing cap and container of the present invention.

Referring to the alternative embodiment of the two-stage dispensing cap for pressurized containers 220 depicted in FIG. 20, an alternative dome shaped sealing disk 210 is provided against the top wall of flip top 225. Annular recess 231 is formed along the inner top wall and receives the disk side sealing surface 215 for compression of the sealing disk 210 between the flip top 225 and the top rim of the neck finish. As shown in FIG. 20, the dome 214 of the dome shaped sealing disk 210 extends downwardly into the interior of the neck finish and forms an adequate seal between the flip-top 225 and the neck, particularly when the contents in the container are pressurized. The embodiment shown in FIG. 20 combines multiple sealing surfaces on the flip top 225 in conjunction with the dome shaped sealing disk 210 and rim of the neck on the container. Thus, annular ring 229 formed on the top wall of the flip top works in conjunction with annular seal 213 formed on the sealing disk 210 and also with sealing flange 212 which depends downwardly along the outer periphery thereof.

As shown in FIG. 20, multiple contact points are provided between the sealing disk and the neck finish as well as the flip top. The disk side sealing surface 215 contacts the outer wall of the annular recess 231 of the flip top and the annular seal 213 contacts the top rim of the container. Sealing flange 212 extends downwardly along the exterior periphery to prevent leakage of the fluid contents of the container as well as prevent leakage of the pressurized gases contained therein. Additionally, the annular ring 229 further provides a sealing mechanism between the sealing disk 210 and the inner side wall of the neck. As can be seen from FIG. 20, as pressure increases in the interior of the container, the dome 214 will move slightly upward causing a better sealing mechanism to occur between the annular ring 229, inner side wall of the neck finish, annular seal 213 and sealing flange 212. Thus, the sealing disk 210 of the embodiment depicted in FIG. 20 replaces the plugs seal previously disclosed and will cause a pinching action of the outer flange 212 to obtain a proper and adequate seal between the sealing disk and the container side wall.

Figure 21:
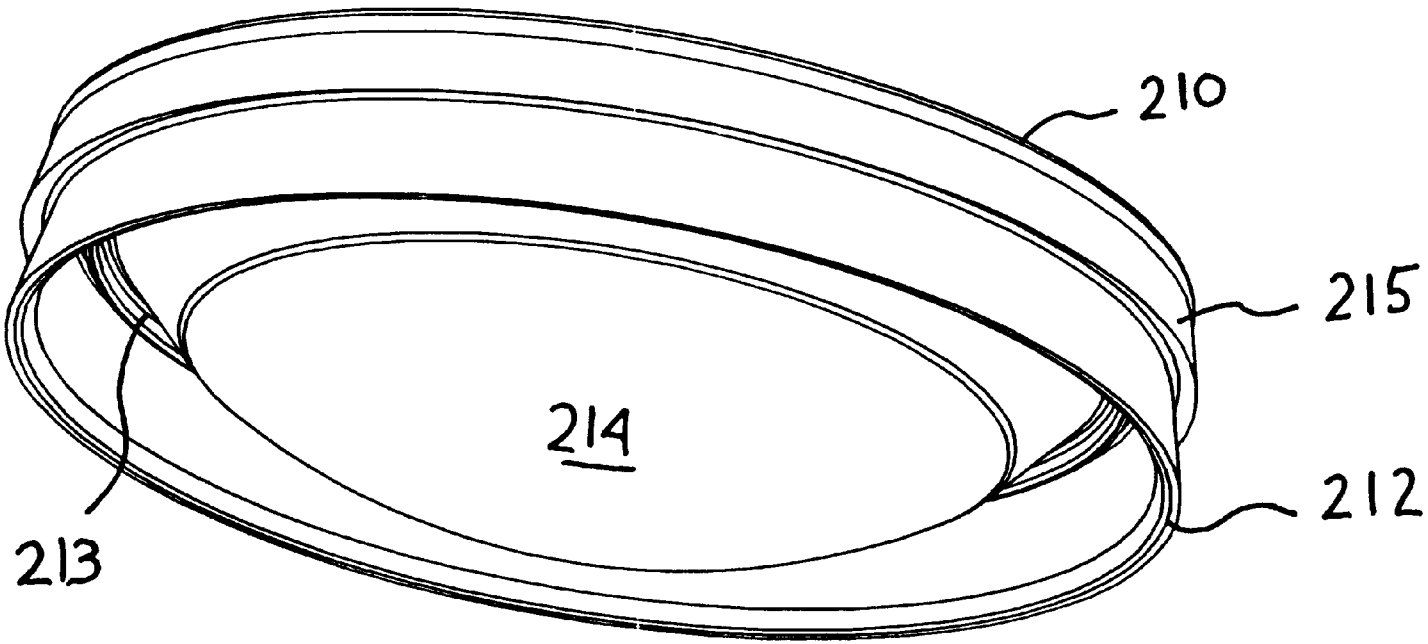
FIG. 21 is a lower perspective view of the ceiling disk used in the alternative embodiment of FIG. 20.

The dome shaped sealing disk 210 of the present embodiment in depicted more clearly in FIG. 21 wherein the disk side seal surface 215 and the sealing flange 212 is clearly shown as well as the annular seal member 213 which contacts the upper rim surface of the neck finish. The pressure dome 214 of the sealing disk is pliable so that as pressure increases in the container, the pressure dome moves upward increasing the sealing capability of the dome shaped sealing disk 210 in combination with sealing flange 212.

Figure 22:
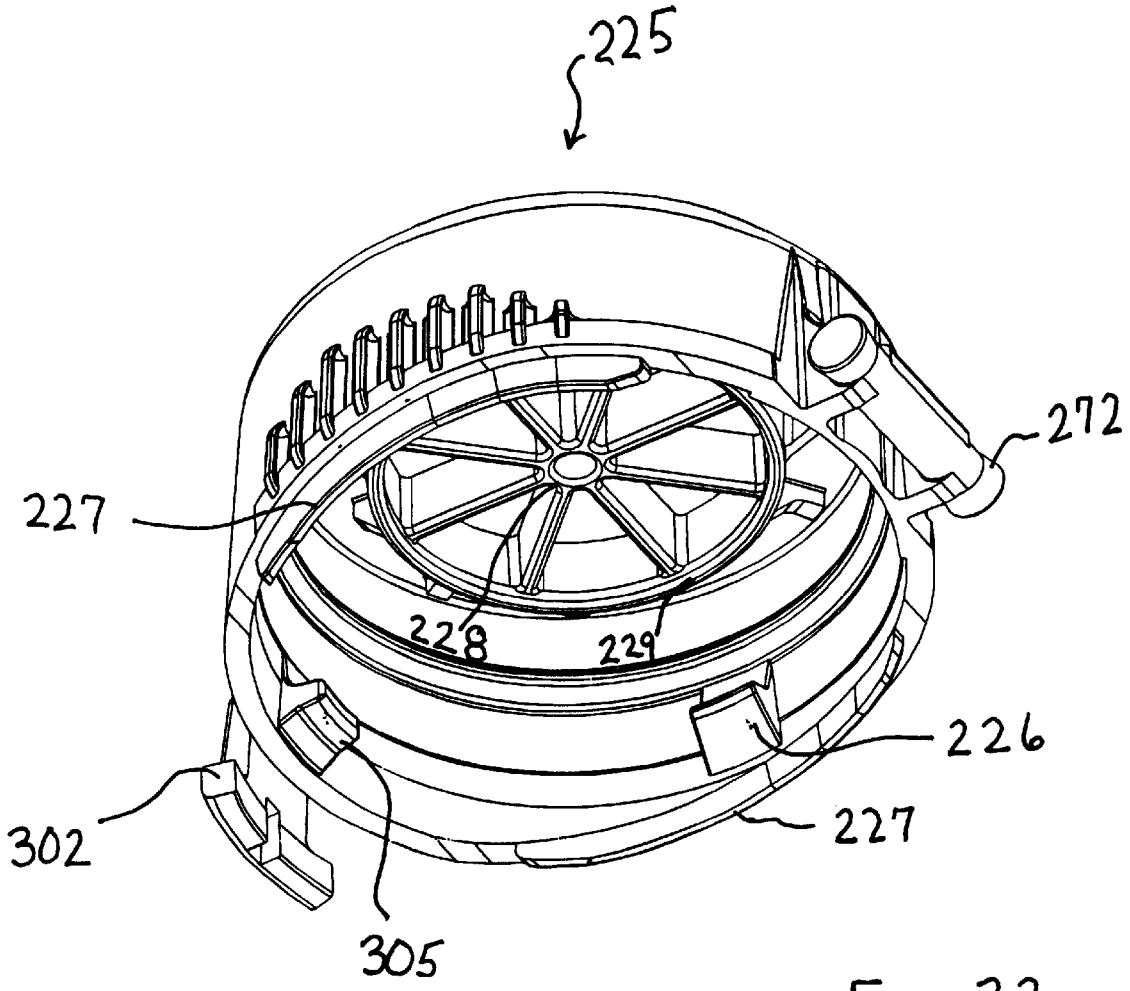
FIG. 22 is a lower perspective view of the flip top depicted in FIG. 20.

As depicted in FIG. 22, the alternative embodiment flip top 225 which works in conjunction with the sealing disk 210 is shown. A motion limiter 228, prevents the complete upward flexure of the pressure dome 214 while the angular ring 229, also shown in FIG. 20, which causes a pinching action between the sealing disk and the container side wall, is visible. Also in the construction of the flip-top 225 depicted in FIG. 22 is a secondary latch mechanism 226 to be discussed herein.

Figure 23:
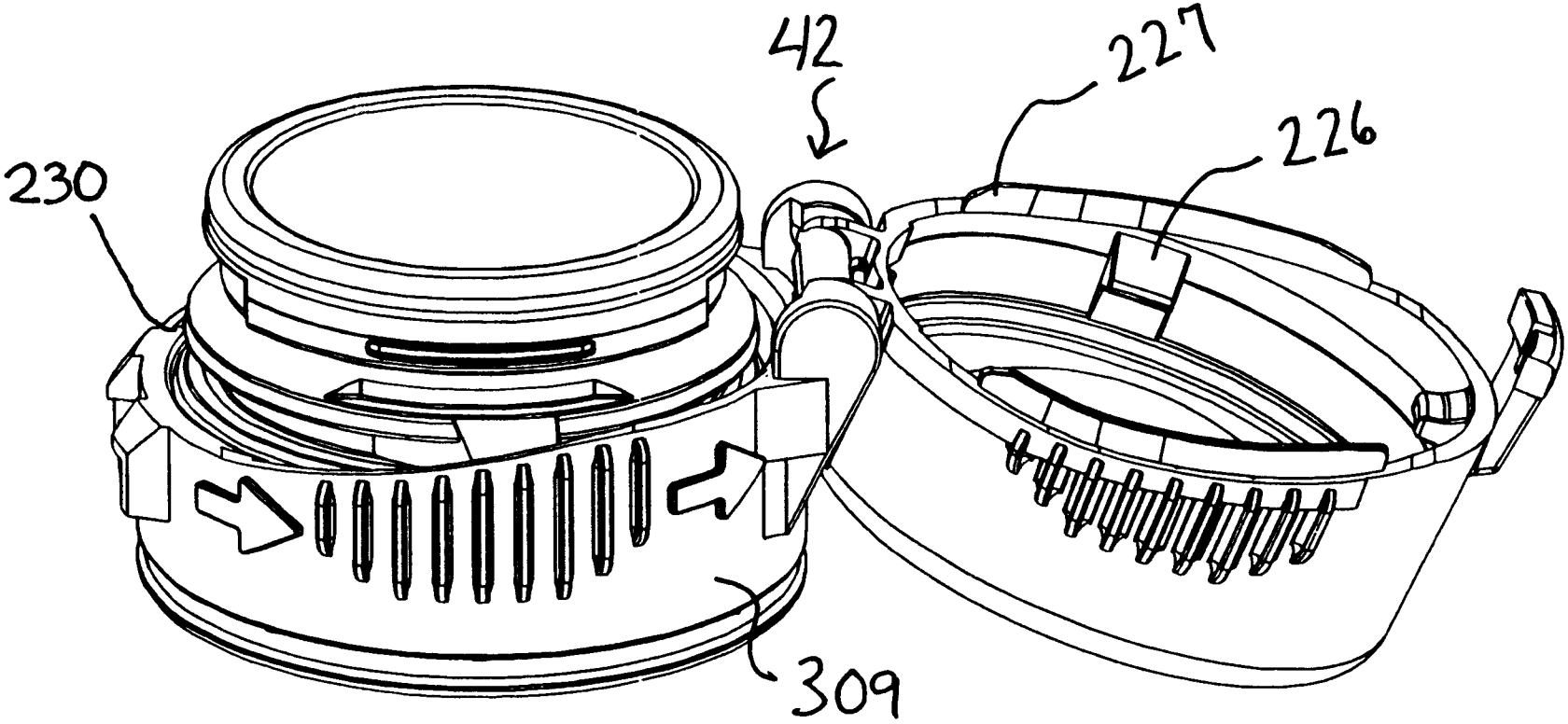
FIG. 23 is a perspective view of the flip top and neck finish of the alternative embodiment depicted in FIG. 20.

Another secondary latch is formed directly opposite to the latch 226 depicted in FIG. 22 but which is not visible because of the view but is visible in FIG. 23. However, both secondary latches 226 are utilized to more firmly retain the flip top 225 in the fully closed position. Thus, the flip top 225 may not be opened simply by deforming the T-bar 302 outward and removing the engagement of the primary latch or retaining lug 305 with the primary lower retaining bead 54 on the neck finish 260 shown in FIG. 24. Thus, when the contents in the container are under significant pressure, multiple latches are provided to retain the flip-top 225 in the closed and sealed position. These multiple retaining mechanisms include both of the secondary latches 226 as well as the primary latch or retaining lug 305.

Also depicted in FIG. 22 are the downward extending rims 227 which are on opposite sides of the flip top side wall and extend downward therefrom. The downwardly extending rims 227 are provided so that when the flip top 225 is in the closed and latched position the neck finish of the container is not visible between the collar portion and the lower edge of the flip top 225. This may be particularly important when the contents within the container are under significant pressure thereby forcing the flip top slightly upward. It may therefore be desirable so that an extension is provided between the flip top and the collar portion such that the neck finish is not visible. The extensions extend downward therefore to cover any potential separation, although it may be minimal, between the collar portion and the flip top.

Additionally, the downwardly extending rim 227 on either side of the flip top may work in conjunction with the collar portion 309 by providing rim receiving recesses 230 therein. Thus, the rim receiving recess 230 shown partially in FIG. 23 will receive the downward extension 227 on either side of the flip top which will thereby reduce any rotational pressure transferred from the collar portion 309 to the flip top through the hinge 42. As has been described, upon opening of the two stage dispensing cap of the present invention, rotational pressure is applied to the collar portion. This rotation is applied mainly to the collar portion 309 and not to the flip top. Thus, all of the rotational force is transferred to the flip top through the hinge 42 to reduce the stress on the hinge and potential deformation of the hinge mechanism. The downwardly extending rims 227 are received into rim receiving recess 230 on either side of the collar portion such that contact there between allows rotation of the collar portion in conjunction with rotation of the flip top.

Also clearly depicted in FIG. 23 as also is displayed in FIG. 20 and FIG. 22, is the secondary latch mechanism 226. Secondary latch mechanism 226 is formed on the inner side wall of the flip top 225. As depicted in FIG. 20, the secondary latches are in an opposing relationship 180 degrees part from the side wall and are retained below upper bead 52 on the neck finish depicted in FIG. 24 when the flip top is closed. As can be seen from FIG. 20 and from FIG. 24, secondary latch windows 233 are formed on opposing sides of the neck finish 260 which allows the release of the flip top once the primary lug or primary latch 305 passes over primary lower cam 256. As depicted in FIG. 20, the side view shows the secondary latch windows 233 such that there is no contacting relationship between the bead 52 and the secondary lugs 226. However, in normal operation when the flip-top 225 is in the closed and locked position, lugs 226 will be below upper bead 52 and primary latch or primary lug 305 will be maintained below lower bead 54.

Figure 24:
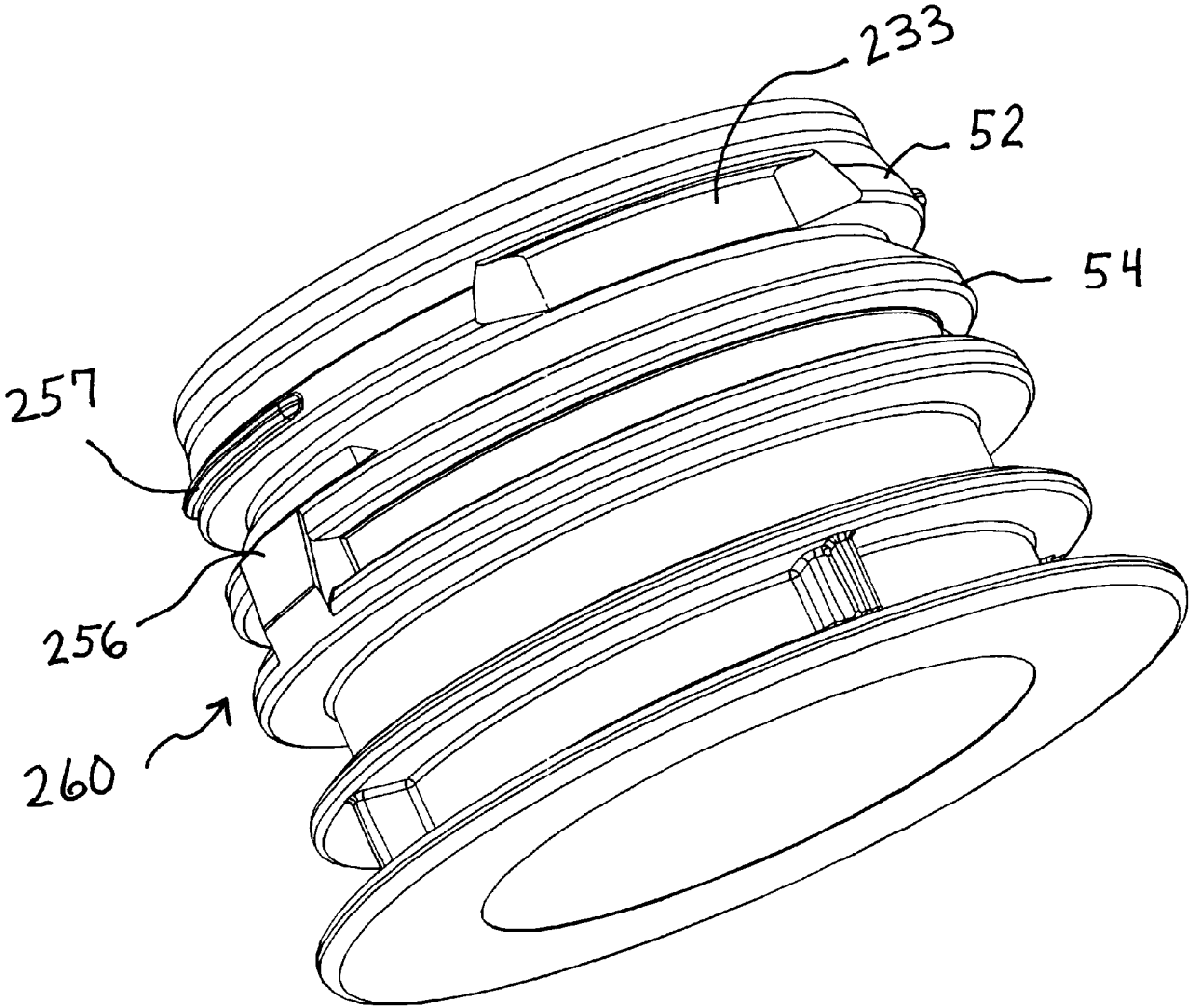
FIG. 24 is side perspective view of the neck finish depicted in FIG. 23.

In operation, the neck finish 260 depicted in FIG. 24 may, as an example, work as follows. Upon initial rotation of the collar portion 309, primary latch 305 will ride over primary lower cam 256 causing the primary latch to rise over lower bead 54. Since the contents in the container are under pressure, a retaining extension 257 is provided on upper bead 52 in order to prevent the primary latch 305 from over-riding upper bead 52. Thus, when the primary latch 305 contacts primary lower cam 256 and is forced upward over lower bead 54, lid retaining extension 257 in combination with upper bead 52 maintains the flip-top 225 in the venting partially closed position. Upper bead 52 will maintain the flip top in the venting position by retaining primary latch 305 there below. Lugs 226 have a dual purpose, one for sealing integrity and maintaining the flip top in the closed and locked position. Also, lugs 226 will help ensure that the venting position is not over-ridden by upward pressure and force from the container headspace. Windows 233 formed on opposite sides of the neck finish 260 will release the secondary lugs 226 upon continued rotation of the closure and allow them upward and through the upper bead 52. Continued rotation of the neck finish will also fully release the flip top works as previously described.

Of course, a significant number of equivalent structure will work in conjunction with the described closure. Of particular note is that sealing disc 210 may be of many alternative shapes and particularly may work with a number of different design flip-top closures, not necessarily the two stage flip top described herein. These alternative structural designs are well within the ability of one of ordinary skill in the art and the specific structural descriptions and locations of the secondary latch mechanisms, window openings, primary latch, flip top and other elements described herein are not meant to be limiting but are for exemplary purposes to describe the invention hereof.

Figure 25:
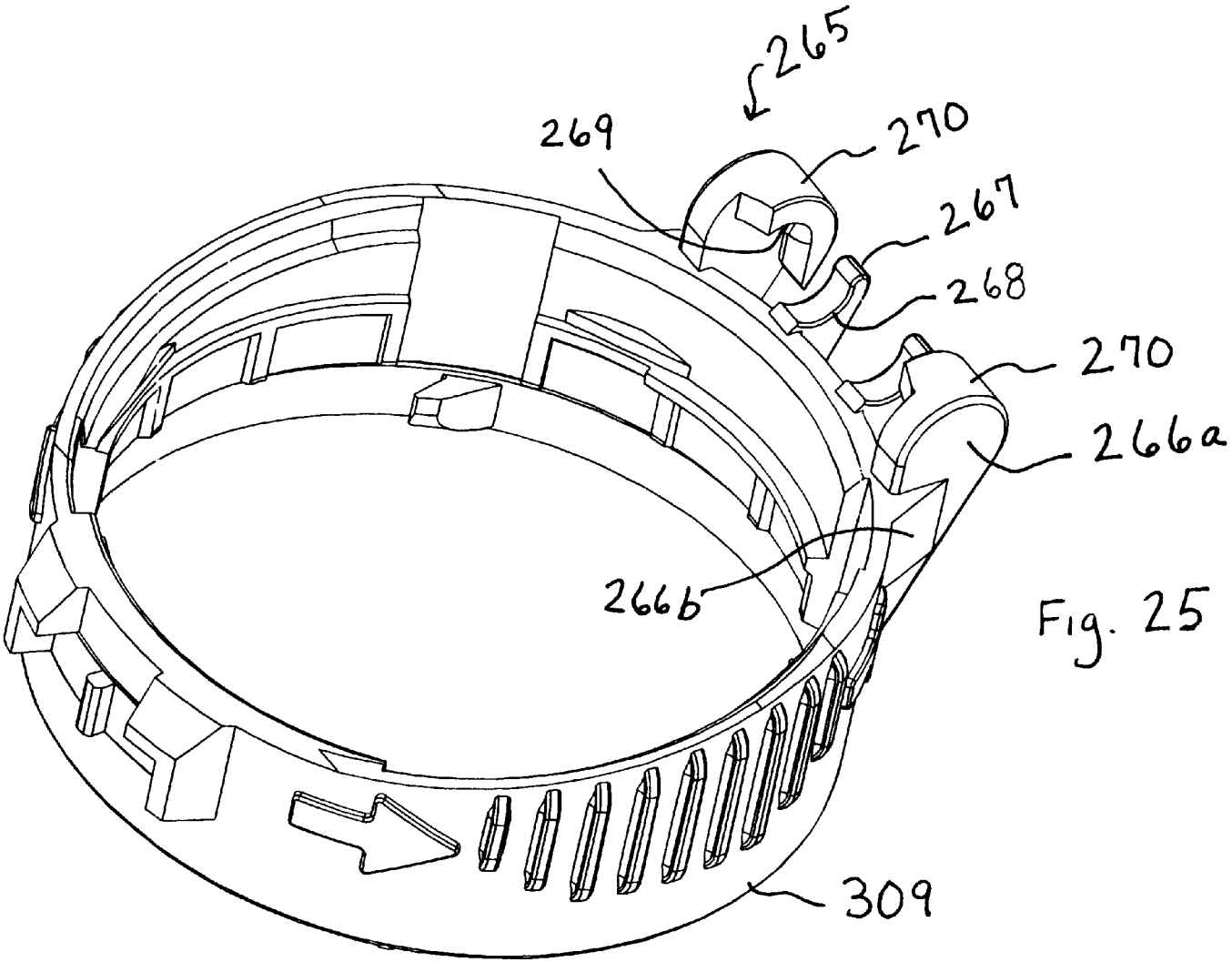
FIG. 25 is a top perspective view of the alternative embodiment of the collar of the present invention.

Finally, in combination with the flip top 225 described herein, collar portion 309 may also be constructed such that a hinged mechanism 265 is provided with added support. Gussets 266 shown in FIG. 25 are provided on either side of hinge arms 270 which have formed on the inner wall thereof hinge recesses 269. Hinge support arms 267 have concave recesses 268 to receive the hinge mechanism of the flip top. Thus, the hinge design is much more simplified and is strengthened significantly. Upon manufacturing of the hinge 265 on this alternative embodiment, the hinge post 272 shown in FIG. 22 is received within hinge recess 269 and supported by hinge support 267. Thus, the hinge post can be readily inserted during the manufacturing step into the hinge mechanism 265 and is securely supported on either side by gussets 266*a* and 266*b* to prevent deformation thereof.

A further aspect if the flip top closure of the present invention is shown in FIG. 22 wherein the flip top 225 has an outer wall which is substantially circular except for one section. This non-circular flat planar section is shown in FIG. 22 as directly above the hinge post 272 and aids in the allowance of fixed chucks for capping operations. Further, as shown therein, the hinge post 272 has a first and a second distal end, both of which are shown as being frusto-conical in design and shape so as to allow for a snap fit into the hinge arms 270 or to maintain their position with the arms. Further, as depicted in FIG. 25, the arms 270 have an open cut-out section adjacent the interior portion of the collar which provides an opening to recess portion 269. This cut-out section allows for horizontal insertion of the hinge post 272 into the hinge 265.

The bottom surface or edge of the collar portion 309 shown in FIG. 17 is additionally shown without knurling and being unobstructed so as to increase the handling capability of the assembled cap or of the collar portion by itself. Finally, as is depicted in FIG. 25, the collar portion 309 has an interior side wall which has a plurality of vertical ribs formed thereon to increase the strength of the collar section and prevent deformation thereof, particularly when used in conjunction with the removable tamper indicating band frangibly connected thereto.

The foregoing detailed description is given primarily for clearness of understanding and no unnecessary limitation are to be understood therefrom for modifications will become obvious to those skilled in the art upon reading this disclosure and may be made without departing from the spirit of the invention or the scope of the appended claims.

What is claimed is:

1. A flip top dispensing closure for a container, comprising:

a container, said container having an upwardly extending neck;

said dispensing closure having a collar portion and a flip top hingedly connected thereto, said flip top having a top wall and a depending annular side wall;

said neck having an upper bead, a lower bead and a primary lower cam adjacent said lower bead;

a lid retaining lug extending inward from said annular side wall of said flip top;

wherein said lid retaining lug is retained below said lower bead when said dispensing closure is in the closed position;

and further comprising at least one secondary latch mechanism extending inwardly from said side wall of said flip top annular side wall;

wherein said at least one secondary latch mechanism is retained below said upper bead on said neck when said flip top is in the closed position.

2. The closure of claim 1 wherein said at least one secondary latch mechanism is a first and a second secondary lug extending inward from said annular side wall of said flip top.

3. The closure of claim 1 wherein said collar portion and said flip top is rotatably connected to said container neck.

4. The closure of claim 1 further comprising a secondary cam, said secondary cam adjacent to said upper bead.

5. The closure of claim 1 further comprising:

a tamper indicating band frangibly connected to said collar portion, at least one tamper indicating lug on an inner wall of said tamper indicating band;

an outwardly extending ratchet formed on said neck of said container, said ratchet in an interference relationship with said tamper indicating lug when said collar portion is rotated.

6. The closure of claim 1 wherein said closure further comprises:

a T-shaped latch depending from said annular side wall;

a recess within said collar portion co-adjacent said latch and receiving said latch therein.

7. The closure of claim 1 wherein said flip top side wall has a downwardly extending rim extending downwardly from a lower edge thereof and received within a rim receiving recess formed in said collar portion.

8. The closure of claim 1 wherein said-neck has at least one secondary latch window formed in said upper bead to release said at least secondary latch mechanism when said closure is opened.

9. The closure of claim 1 wherein said flip top is further comprised of an outer wall, said outer wall having a non-circular flat planar section above said hinge.

10. The closure of claim 1 wherein said collar portion has an upper section and a lower section, said lower section having an unobstructed surface.

11. The closure of claim 1 further comprising a plurality of vertical ribs formed on an interior side wall of said collar portion.

12. The closure of claim 1 further comprising a depending latch extending downward from said annular side wall.

13. The closure of claim 12 wherein said depending latch is a T-bar latch having outwardly extending retaining projections formed therein, said collar portion having a catch recess which receives said projections.

14. The closure of claim 13 wherein said upper bead on said container neck has an outer diameter which is less than the inner diameter of said flip top side wall to said lid retaining lug.

15. The closure of claim 1 further comprising:

a dome shaped sealing disc positioned within an interior top wall of said flip top and extending spherically downwardly therefrom.

16. The closure of claim 15 further comprising a motion limiter extending downward from said interior top wall of said flip top.

17. The closure of claim 15 wherein said dome shaped sealing disc is further comprised of a downwardly extending pressure dome, a disc side sealing surface on a peripheral edge of said pressure dome and a sealing flange extending downward from said peripheral edge.

18. The closure of claim 17 wherein said flip top has an annular recess which receives said disc side sealing surface therein.

19. The closure of claim 1 further comprising a cylindrical hinge post extending outwardly from said flip top side wall;

a first and a second hinge arm extending outwardly from said collar portion to receive said hinge post;

at least one hinge support arm below and supporting said hinge post;

wherein said first and second hinge arms have a gusset connecting each of said hinge arms to said collar portion.

20. The closure of claim 19 wherein said hinge post has a first and a second distal end, said first and second distal end being frusto-conical.

21. The closure of claim 19 wherein said first and second hinge arm extending outwardly from said collar portion have a cut-out section allowing for horizontal insertion of said hinge post into said hinge arm.

22. The closure and container of claim 21 further comprising at least one secondary latch window formed in said upper bead on said container to release said at least one secondary latch mechanism when said closure is opened.

23. A flip top dispensing closure for a container, comprising:

a container, said container having an upwardly extending neck;

said dispensing closure having a collar portion and a flip top hingedly connected thereto, said flip top having a top wall and a depending annular side wall;

a dome shaped sealing disc positioned within an interior top wall of said flip top and extending spherically downwardly therefrom;

said neck having an upper bead, a lower bead and a primary lower cam adjacent said lower bead;

a lid retaining lug extending inward from said annular side wall of said flip top;

wherein said lid retaining lug is retained below said lower bead when said dispensing closure is in the closed position;

at least one secondary latch mechanism extending inwardly from said side wall of said flip top annular side wall, wherein said at least one secondary latch mechanism is retained below said upper bead on said neck when said flip top is in the closed position.

24. A flip top dispensing closure for a container, comprising:

a container, said container having an upwardly extending neck;

said dispensing closure having a collar portion and a flip top hingedly connected thereto, said flip top having a top wall and a depending annular side wall;

a dome shaped sealing disc positioned within an interior top wall of said flip top and extending spherically downwardly therefrom;

said neck having an upper bead, a lower bead and a primary lower cam adjacent said lower bead;

a lid retaining lug extending inward from said annular side wall of said flip top;

wherein said lid retaining lug is retained below at least one of said beads when said dispensing closure is in the closed position;

at least one secondary latch mechanism extending inwardly from said side wall of said flip top annular side wall, wherein said at least one secondary latch mechanism is retained below at least one of said beads on said neck when said flip top is in the closed position.

* * * * *